US007114272B2

(12) United States Patent
Clendenning et al.

(10) Patent No.: US 7,114,272 B2
(45) Date of Patent: Oct. 3, 2006

(54) WINGED DIGGING TOOTH

(75) Inventors: Charles Clendenning, Broken Arrow, OK (US); Brian L. Launder, Tulsa, OK (US)

(73) Assignee: H&L Tooth Company, Tulsa, OK (US)

( * ) Notice: Subject to any disclaimer, the term of this patent is extended or adjusted under 35 U.S.C. 154(b) by 76 days.

(21) Appl. No.: 10/828,704

(22) Filed: Apr. 21, 2004

(65) Prior Publication Data

US 2005/0050775 A1 Mar. 10, 2005

Related U.S. Application Data

(60) Provisional application No. 60/501,381, filed on Sep. 9, 2003.

(51) Int. Cl.
*E02F 9/28* (2006.01)

(52) U.S. Cl. ..... 37/452; 37/450

(58) Field of Classification Search .. 172/701.1–701.3; 37/446, 452–468

See application file for complete search history.

(56) References Cited

U.S. PATENT DOCUMENTS

| | | | | |
|---|---|---|---|---|
| 1,009,254 | A | | 11/1911 | McKenzie |
| 1,796,737 | A | | 3/1931 | Van Buskirk |
| 1,843,205 | A | | 2/1932 | Clark |
| 1,959,847 | A | | 5/1934 | Van Buskirk |
| 2,005,016 | A | | 6/1935 | Van Buskirk |
| 2,167,425 | A | | 7/1939 | Page |
| 2,385,395 | A | | 9/1945 | Baer |
| 2,623,309 | A | | 12/1952 | Frye |
| D190,335 | S | | 5/1961 | Livermore |
| D207,448 | S | | 4/1967 | Wilson |
| D207,451 | S | | 4/1967 | Wilson |
| 3,422,915 | A | * | 1/1969 | Watts ..... 175/388 |
| 3,606,471 | A | * | 9/1971 | Evans ..... 299/112 R |
| 3,888,028 | A | | 6/1975 | White |

(Continued)

FOREIGN PATENT DOCUMENTS

| | | |
|---|---|---|
| GB | 1297827 | 11/1972 |

(Continued)

*Primary Examiner*—Meredith C. Petravick
(74) *Attorney, Agent, or Firm*—John W. Harbst

(57) ABSTRACT

A digging tooth adapted to extend forward from a leading edge of a bucket or the like. The digging tooth has a forward end, with an edge extending thereacross, and a rear end. The digging tooth further includes wing structure preferably formed integral with the digging tooth and extending from a surface on the tooth so as to provide the bucket with enhanced ground penetration capability while concomitantly shielding ground engaging components disposed rearwardly of a rear end of the digging tooth against wear and, thus, potentially extending the useful wear life of such components.

72 Claims, 12 Drawing Sheets

U.S. PATENT DOCUMENTS

| | | | |
|---|---|---|---|
| 3,947,982 | A | 4/1976 | Mantovani |
| D243,843 | S | 3/1977 | Edwards |
| 4,050,172 | A | 9/1977 | Peterson |
| 4,083,605 | A | 4/1978 | College et al. |
| 4,117,611 | A | 10/1978 | Hemphill |
| 4,208,816 | A | 6/1980 | West |
| 4,317,299 | A | 3/1982 | Funk |
| 4,329,798 | A | 5/1982 | Edwards |
| D285,691 | S | 9/1986 | Johnson |
| 4,642,920 | A | 2/1987 | Lehnhoff |
| 5,188,680 | A | 2/1993 | Hahn et al. |
| D354,291 | S | 1/1995 | Edwards |
| 5,499,686 | A | 3/1996 | Parker |
| 5,778,570 | A | 7/1998 | Eichelberger |
| D411,546 | S | 6/1999 | Chapman |
| D415,173 | S | 10/1999 | Zaun |
| D415,773 | S | 10/1999 | Chapman |
| 6,070,345 | A | 6/2000 | Akaki et al. |
| D429,257 | S | 8/2000 | Zaun |
| D429,258 | S | 8/2000 | Zaun |
| 2003/0010157 | A1 | 1/2003 | Bruce |

FOREIGN PATENT DOCUMENTS

| | | |
|---|---|---|
| WO | WO 2005/005737 A1 | 1/2005 |

* cited by examiner

WINGED DIGGING TOOTH

RELATED APPLICATIONS

This application claims the benefit of provisional Application Ser. No. 60/501,381, filed Sep. 9, 2003.

FIELD OF THE INVENTION

The present invention generally relates to ground engaging implements and, more particularly, to a digging tooth adapted to be secured to and project forward from a leading or forward edge of a bucket or the like.

SUMMARY OF THE INVENTION

Buckets of varying sizes and shapes are commonly arranged in operable combination with backhoes, front loaders, excavators and related earthworking equipment. Most buckets include areas, i.e., the leading bucket edge, bucket side walls, etc., which are exposed and, thus, are highly susceptible to wear, especially when the bucket is used in abrasive and rocky environments. In many bucket designs, a one-piece, transversely elongated base edge or lip is welded to other bucket walls and serves as a leading edge for the bucket. The bucket edge is frequently provided with a sharpened or beveled design to enhance ground penetration capability for the bucket. As will be appreciated, in highly compacted soil conditions and/or rocky terrain, a significant force is required to allow the bucket edge to penetrate such ground conditions.

To further enhance ground penetration with the leading edge of the bucket, a series of laterally spaced digging teeth are known to be arranged across and extend forward from the bucket edge. Each digging tooth has a transverse edge at a forward or front end thereof for fracturing the ground in advance of and, thus, promoting penetration by the remainder of the digging tooth and, ultimately, by the bucket edge. As will be appreciated, having the digging tooth fracture the ground in advance of the bucket edge furthermore facilitates gathering of ground material into the bucket.

Some digging teeth are of one-piece or unitary construction and design. A rear portion of a one-piece digging tooth is typically configured for attachment, as by welding, to the bucket edge or lip, while the remaining portion of the digging tooth is configured to extend forward from the bucket edge to fracture the ground in advance of the bucket edge penetrating the ground.

A vast preponderance of ground engaging teeth, however, are designed as two-part systems. A conventional two-part digging tooth system or assembly includes a digging/ground engaging tooth and an adapter arranged in operable combination with each other. The adapter includes a base or mounting portion and a nose portion projecting forward from the bucket edge and to which the digging tooth is releasably attached. In many applications, the base of the adapter is secured, as by welding to the leading edge of the bucket. In some designs, another wear component, in the form of a cap, is provided rearwardly of the digging tooth for adding wear protection to the adapter.

Regardless of the particular design of the digging tooth, be it of one -piece design or configured as a two-part system or assembly, wear and deterioration of the leading bucket edge is a very serious concern. The leading or cutting edge of the bucket is typically quite hard to protect against impacts, wear, and undue stress associated with typical excavating operations, while protection of the leading or cutting bucket edge remains of paramount importance. While lengthwise portions of the bucket edge are protected by the mounting portion of either design of the digging tooth, those portions of the bucket edge spanning the distance between adjacent laterally spaced digging teeth remain exposed to the same harsh and wearing environment as the digging teeth. Unfortunately, the front cutting edge of the digging tooth provides only a limited ground fracturing zone in advance of the bucket cutting edge. As such, known digging tooth designs have limited affects on the compacted ground material passing between adjacent digging teeth. Due to the onerous economic penalties associated with replacing the bucket cutting edge and related hardware replacement, some companies add a costly carbide hardfacing process to extend the life of those portions of the bucket edge between laterally adjacent digging teeth. Such carbide hardfacing applications, however, often exceed the cost of a new bucket edge.

The components of two-part digging tooth systems are typically maintained in operable combination relative to each other by various types of retaining devices. The majority of known retaining devices are either of a flex-pin type or a pin and retainer type. Hundreds of thousands of older backhoes use a well known flex-pin retainer for maintaining a tooth and adapter in operable combination with each other. Pin and retainer systems are also used on tens of thousands of older ground engaging implements and machines for maintaining a digging tooth and adapter in operable combination relative to each other. As ergonomics play more of a part in digging tooth designs, vertically and even diagonally disposed retainer devices and designs have also become increasingly more popular due to their convenient access.

Compatibility between component parts of the two-part digging tooth system is also an important concern. Because of the immense quantity of existing implements, the presence and location of certain design features on known two-part digging tooth systems requires consideration when contemplating changes to either component of the digging system. That is, when design changes are considered for either component of a two-part digging tooth assembly, the ancillary affects such changes can have on existing bucket designs should also be carefully considered. To reduce costs to the end user, most changes to either component of the two-part digging tooth system should be compatible with equipment already in the field. In this regard, lost production and costly welding and replacement repairs continue to plague the industry. For example, when a digging tooth is changed without considering the affects such change can have on the adapter, even a simple change to a digging tooth may further require cutting of the existing adapter from the bucket base edge followed by welding of a new adapter to the bucket base edge to accommodate such change to the tooth. In the interim, the bucket and machine remain out of service for the duration of the retrofitting process. Wear of a bucket cutting edge also requires extensive and time consuming repairs. Besides considerable time being spent on cutting the blade edge from the remainder of the bucket, replacing a worn blade edge often requires the additional step of replacing all the adapters thereon. Of course, replacing the adapters requires further efforts to attach all new adapters to the new blade edge. Replacing both the blade edge, and especially a beveled blade edge, and the adapters are both costly and time consuming.

Thus, there is a need and continuing desire for a digging tooth which is designed to offer enhanced wear protection to wear components disposed rearwardly thereof while maintaining compatibility with existing digging tooth systems.

SUMMARY OF THE INVENTION

In view of the above, and in accordance with one aspect there is provided a digging tooth adapted to extend forward from a digging implement having a transversely extending edge. The digging tooth defines a longitudinal centerline and has a forward end portion, with a cutting edge extending thereacross, and a rear end portion configured for attachment to the edge of the implement. The digging tooth further includes upper and lower angularly diverging surfaces having opposed side surfaces therebetween. The digging tooth further includes a wing projecting laterally outwardly from each side surface on the tooth. Each wing is preferably formed integral with the remainder of the tooth and has upper and lower planar surfaces each extending in a direction generally paralleling the cutting edge across the forward end portion of the tooth. The upper surface of each wing is disposed between the upper and lower surfaces of the tooth and in other than planar relationship relative to the upper surface of the digging tooth. In one form, the lower surface of each wine is disposed in between the upper and lower surfaces of the tooth and in other than planar relationship with the lower surface of the digging tooth. Moreover, each wing has a laterally widened rear portion, a laterally narrowed forward portion, and an outer edge extending therebetween for providing the tooth with a progressively widening ground fracturing zone whereby adding significant wear protection for the edge of the implement.

In a preferred embodiment, the rear end portion of the digging tooth is provided with a blind cavity for receiving and accommodating a lengthwise section of a nose portion of an adapter extending from the bucket edge or lip. In a most preferred form, the blind cavity at the rear end portion of the tooth has a generally rhombus-like configuration for a major lengthwise portion thereof. In one form, the laterally widened portion of each wing extends outward and forward from the rearward portion of the tooth.

In that form of the digging tooth having a blind cavity defined at the rear end portion thereof, the digging tooth further defines a bore opening to the blind cavity for accommodating at least a portion of a retaining apparatus used to releasably secure the tooth and adapter in operable combination relative to each other. Preferably, one of the upper and lower generally planar surfaces on each wing of the tooth further defines an open groove or channel arranged in general alignment relative to each other and relative to an axis of the bore defined by the tooth. The open channel on the planar surface of each wing serves to both accommodate and align a pin of the retaining apparatus with the bore defined by the tooth.

Many operators prefer to use a flex-pin retainer as the retaining apparatus of choice for holding the digging tooth and adapter in operable combination relative to each other. In this regard, and in a preferred embodiment, an area, arranged in proximate relation relative to the bore defined by the tooth, is configured to impart compression to a conventional flex-pin retaining apparatus as the flex-pin is inserted into a position to maintain the tooth and adapter in operable combination relative to each other.

In another embodiment, an area, arranged in proximate relation relative to the bore on the digging tooth, is configured to inhibit inadvertent axial shifting of the retaining apparatus relative to the adapter or tooth. In still another form, each wing extends laterally outward from an area on opposed side surfaces of the tooth proximately midway between the upper and lower surfaces of the digging tooth. In this embodiment, and when combined with providing an open top channel in the pin receiving area on each tooth, the upper generally planar surface of each wing on the tooth is configured to protect ends of the retaining apparatus extending beyond opposed sides of the digging tooth. To enhance the ability of the digging tooth to slice through and fracture the ground, an elongated outer edge portion on each wing is configured with a cutting edge.

According to another aspect, there is provided an elongated digging tooth adapted to extend forward from a digging implement having a transversely extending edge. The digging tooth defines a central axis and has a forward end portion, with a transverse cutting edge, and a rear end portion configured for attachment to the transversely extending edge of the implement. The digging tooth further includes upper and lower angularly diverging surfaces having opposed side surfaces therebetween. The digging tooth further includes wing structure projecting generally horizontally and laterally outward from an area on one side of the tooth. The wing structure is preferably formed integral with the remainder of the digging tooth and has generally horizontal upper and lower surfaces. In one form, the upper and lower surfaces of the wing structure are disposed between and in other than planar relationship relative to the upper and lower surfaces of the digging tooth. The wing structure has a laterally widened rear portion, a laterally narrowed front portion, and an outer edge extending therebetween and, for a major portion of the length thereof, converges toward the central axis of the tooth so as to provide the digging tooth with a widening ground penetration zone for facilitating penetration of the bucket edge.

In one form, a major lengthwise portion of the outer edge of the wing structure is configured to enhance the ability of the wing to slice through and fracture the ground. Preferably, the wing structure is disposed on the tooth in generally symmetrical relation relative to the central axis of the tooth whereby permitting the digging tooth to be reversed about the central axis.

In another form, the digging tooth is provided with a second wing structure is projecting generally horizontally and laterally outward from an area on an opposite side of the tooth. The second wing structure has generally horizontal upper and lower surfaces, with the upper and lower surfaces of the second wing structure being disposed between and in other than planar relationship relative to the upper and lower surfaces of the digging tooth. The second wing structure preferably has a rear laterally widened portion, a laterally narrowed front portion, and an outer edge extending therebetween and converging toward the central axis of said tooth whereby providing the digging tooth with a widening ground penetration zone for facilitating penetration of the transversely extending edge on the digging implement. In a most preferred form, the wing structure extending from those areas on opposed sides of the tooth are arranged proximately midway between the upper and lower surfaces of said tooth.

In a preferred embodiment, the rear end portion of the digging tooth is provided with a blind cavity for receiving and accommodating a lengthwise section of a nose portion of an adapter extending from the bucket edge or lip. In a most preferred form, a marginal edge extending about the blind cavity provided at the rear end portion of the tooth has a generally rhombus-like configuration for a major lengthwise portion thereof. In that embodiment wherein the blind cavity has a generally rhombus-like configuration, the digging tooth further defies a pair of axially aligned bores which each open to the blind cavity and are disposed along an axis extending at an angle ranging between about 25° and about 65° relative to the transverse cutting edge at the forward end portion of the tooth. In another form, the laterally widened portion of each wing extends outward and forward from the rear end portion of the tooth. In still another form, the digging tooth further includes opposed surfaces arranged within the blind cavity defined by the tooth for adding stability to the tooth during a digging operation.

According to another aspect, there is provided, in combination, a bucket having a forward edge and a plurality of two-part digging tooth assemblies connected to the edge in side-by-side relation. Each digging tooth assembly includes an adapter having a nose portion extending forward from the bucket edge and to which a replaceable digging tooth is secured. Each digging tooth has a forward end, with an edge transversely extending thereacross, a rear end, positioned adjacent to the bucket edge and defining a blind cavity for receiving the nose portion of the adapter, an upper surface extending forward and downwardly from the rearward end and toward the forward end of said digging tooth, and a lower surface extending forward and upwardly from the rearward end and toward the forward end of the digging tooth. Each digging tooth further has wing structure including a pair of wings extending outwardly in a direction generally parallel to the forward edge on the tooth from an area on each side of the tooth proximate midway between the upper and lower surfaces thereof. Each wing on the tooth has a laterally widened rear portion and a laterally narrowed front portion such that, for a major length thereof, an outer edge of each wing converges toward the central axis of the tooth and diverges relative to the outer edge of a wing on an adjacent tooth. The wings on each tooth are designed to protect the portion of the bucket edge disposed between adjacent tooth assemblies against wear.

In a preferred form, the rear end portion of the digging tooth is configured with a blind cavity for receiving and accommodating a lengthwise section of a nose portion of an adapter extending from the transversely extending edge of the digging implement. The blind cavity can have either a rhombus-like or a generally rectangular cross-sectional configuration.

In one embodiment, each tooth also includes a bore opening to the blind cavity at the rear end of the tooth for accommodating at least a portion of an apparatus used to releasably secure the tooth and adapter in operable combination. In a preferred form, the wing on each digging tooth has upper and lower generally planar surfaces, and with the outer edge of the wing on each digging tooth having angularly converging surfaces to provide each wing with a cutting edge for facilitating ground penetration.

In most preferred form, one of the generally planar surfaces on each wing of the digging tooth further defines an open channel or groove arranged in general alignment with an axis of the bore defined by the tooth for both accommodating and aligning a flex-pin of the retaining apparatus with said the bore defined by the tooth. Moreover, an area of the digging tooth, arranged in proximate relation relative to the bore, is preferably configured to compress a flex-pin retaining apparatus as the flex-pin is inserted into a position to maintain said tooth and adapter in operable combination relative to each other. Additionally, an area of the digging tooth arranged in proximate relation relative to the bore is preferably configured to inhibit inadvertent axial shifting of the retaining apparatus relative to said adapter or tooth. In one form, the generally planar surface of each wing defining the channel is disposed and configured to protect a lengthwise portion of said retaining apparatus extending beyond either side of said digging tooth.

In one design, the tooth of each of digging tooth assembly is configured such that the blind cavity has a generally rhombus-like cross-sectional configuration. In this tooth design, the tooth of each digging tooth assembly defines a pair of axially aligned bores opening to the tooth cavity and disposed along an axis extending at an angle ranging between about 25° and about 65° relative to the transversely extending edge at the forward end of the tooth.

According to another aspect, there is provided a ground engaging tooth adapted to be mounted to a digging implement and having a wear component arranged rearwardly thereof. The ground engaging tooth defines a central axis and has a forward end portion, with an edge extending transversely thereacross, and a rear end portion. The digging tooth further includes upper and lower angularly diverging surfaces having opposed side surfaces therebetween. The digging tooth further includes a free ended projection extending laterally outwardly from each side surface on the tooth. Each wing is preferably formed integral with the remainder of the tooth and has upper and lower planar surfaces each extending in a direction generally paralleling the cutting edge across the forward end portion of the tooth. In one form, the upper and lower surfaces of each wing are disposed between and in other than planar relationship relative to the upper and lower surfaces of the digging tooth. Moreover, each wing has a laterally widened rear portion, a laterally narrowed forward portion, and an outer edge extending therebetween for providing the tooth with a progressively widening ground fracturing zone whereby adding significant wear protection for the edge of the implement.

In a preferred embodiment, the rear end portion of the digging tooth is provided with a blind cavity for receiving and accommodating a lengthwise section of a nose portion of an adapter extending from the bucket edge or lip. In a most preferred form, the blind cavity at the rear end portion of the tooth has a generally rhombus-like configuration for a major lengthwise portion thereof. The tooth is further provided with a free ended projection integrally formed with the remainder of the tooth and extending away from and longitudinally along at least one of the multiple surfaces of the tooth between the rear end portion and forward end portion thereof. A rear portion of the projection extends away from the surface on the tooth from which it projects a greater distance than does a forward portion such that an outer edge of the projection converges from the rear toward the front and toward the central axis of the tooth such that, following initial ground penetration, the outer edge of the projection is disposed to initially fracture the ground through which the tooth passes whereby reducing wear on the wear component arranged rearwardly of the two-piece tooth assembly.

In one form, the projection on the tooth extends away from the upper surface of the tooth in a direction extending generally normal to the edge extending transversely across the forward end of the tooth. In another form, the projection is laterally offset relative to the upper surface of the tooth such that the projection is disposed closer to one side surface of the tooth than the other. In still another form, the projection extends upwardly from and longitudinally along an area generally centralized between the side surfaces on the tooth. Regardless of where the projection is located on the digging tooth, a cutting edge extends along a major portion of the outer extreme of the projection to facilitate ground penetration by the projection.

In yet another embodiment, the rear end portion of the digging tooth defines a blind cavity opening to a rear of the tooth for receiving and accommodating a lengthwise section of a nose portion of an adapter extending from a transversely extending edge of the digging implement. The blind cavity opens to the rear of the digging tooth and, preferably, has a generally rhombus-like cross-sectional configuration for a major lengthwise portion thereof. In another form, the blind cavity has a cross-sectional profile with a rectangular configuration for a major lengthwise portion thereof.

In another embodiment, the projection has upper and lower generally parallel surfaces extending laterally outward from one side surface on the tooth. The upper and lower surfaces of the projection are preferably disposed between and in other than planar relationship relative to the upper and lower surfaces of the digging tooth. In another form, the projection extends laterally from one side surface on the tooth proximately midway between the upper and lower surfaces and in a direction generally parallel to the edge extending transversely across the forward end of the tooth. To promote the versatility of the ground engaging tooth, the projection laterally extending from one side surface of the tooth is preferably disposed symmetrically relative to the central axis whereby permitting the tooth to be reversed about the central axis.

In another embodiment, the ground engaging tooth includes a second free ended projection designed as a mirror image of the other free ended projection. That is, the second free ended projection extends from the other side surface on the tooth. More specifically, such second projection on the tooth extends laterally outwardly from the other side and, in one form, proximately midway between the upper and lower surfaces and in a direction generally parallel to the edge extending transversely across the forward end of the tooth. In both embodiments, the projection is preferably formed as an integral part of the digging tooth.

Preferably, a rear portion of each projection, extending from a respective side surface of the tooth, has generally planar surfaces extending generally parallel to the edge at the forward end of the tooth. In a preferred embodiment, the ground engaging tooth further defines a bore having an axis extending generally normal to the central axis. Such bore in the tooth opens to the blind cavity defined by the tooth for accommodating at least a portion of a retaining apparatus used to releasably secure the tooth and adapter in operable combination relative to each other.

In one embodiment, one of the generally planar surface on each projection defines an open channel arranged in general alignment with the axis of the bore in the tooth for accommodating and aligning the retaining apparatus therewith. As mentioned above, many operators prefer to use a flex-pin type retainer for operably securing the tooth and adapter in operable combination relative to each other. In this regard, and in another form, an area of the tooth arranged proximate to the bore in the tooth is configured to compress the flex-pin type retaining apparatus as the flex-pin of the retaining apparatus is inserted into a position to maintain said tooth and adapter in operable combination relative to each other.

In a preferred embodiment, an area of the digging tooth arranged in proximate relation relative to the bore in the tooth is configured to inhibit inadvertent axial shifting of the retaining apparatus relative to said adapter or tooth. In that form wherein the projection extends from the side surface of the digging tooth, the open channel provided in one of the generally planar surfaces of the respective wing along with the disposition of the generally planar surface defining such channel on the wing is configured to protect a lengthwise portion of the retaining apparatus extending beyond opposed sides of the tooth.

According to still another aspect, there is provided a ground engaging tooth adapted to be mounted to a digging implement and having a wear component arranged rearwardly thereof after being mounted on the digging implement. The digging tooth defines a central axis and has a forward end portion, with a transverse cutting edge, and a rear end portion configured for attachment to the transversely extending edge of the implement. The digging tooth further includes upper and lower angularly diverging surfaces with opposed side surfaces disposed therebetween. The digging tooth is further provided with a first projection extending away from and longitudinally along at least a lengthwise portion of one surface on the tooth. The lengthwise portion of the projection has a length less than a length between the forward and rearward ends of the tooth. The digging tooth is further provided with a second projection extending from the same surface on the tooth rearward of the first projection. During operation, the first and second projections on the tooth combine with each other to advantageously fracture the ground through which said tooth passes whereby reducing wear on the wear component arranged rearwardly of the two-piece tooth assembly.

Preferably, the digging tooth is provided, at the rear end portion thereof, with a blind cavity opening to the rear of the of the tooth for receiving and accommodating a lengthwise section of a nose portion of an adapter extending forward from a leading edge of the digging implement. The cavity opens to the rear of the tooth and defines a generally rhombus-like cross-sectional configuration for a major lengthwise portion thereof. In a most preferred embodiment, the digging tooth further includes third and fourth projections extending from another surface on the tooth disposed in opposed relation relative to the other digging tooth surface from which the first and second projections extend. The third and fourth projections are preferably configured as mirror images of the first and second projections, respectively.

According to another aspect, there is provided an elongated digging tooth for a two-piece digging tooth assembly adapted to be secured to a transversely extending edge of a bucket or the like. The digging tooth defines a central axis and has a front end, with a cutting edge transversely extending thereacross, and a rear end with a blind cavity opening thereto for receiving and accommodating a nose portion of an adapter extending forward from the transversely extending edge of the bucket. The tooth and said adapter each define a bore which are arranged in registry with one another after said digging tooth and adapter are conjoined so as to allow a retaining apparatus to pass at least partially through the bores whereby maintaining the tooth and adapter in operable combination with each other. The bore defined by the tooth defines an axis extending generally normal to the central axis of the tooth, with the digging tooth further including an upper surface extending forward and downwardly from the rear end and toward the cutting edge of the digging tooth, and a lower surface extending forward and upwardly from the rear end and toward the cutting edge of the digging tooth. The digging tooth further includes a generally horizontal projection extending laterally outward from an area on one side of the tooth. The projection has generally parallel and horizontal upper and lower surfaces disposed between and in other than planar relationship relative to the upper and lower surfaces of the digging tooth, with the projection having a laterally widened rear portion, disposed forward of the axis defined by the bore in the tooth and an outer edge extending forward from the laterally widened rear portion of the projection and converging toward the central axis of said tooth whereby providing said digging tooth with a progressively widening ground penetration zone for facilitating penetration of the bucket edge.

In a preferred form, the projection is integrally formed as part of and with the remainder of the tooth. Moreover, the tooth is preferably configured such that a marginal edge extending about the cavity opening to the rear of the tooth has a generally rectangular-like cross-sectional configuration. In a preferred embodiment, the projection is arranged on the tooth in generally symmetrical relation relative to the central axis whereby permitting said tooth to be reversed about the central axis. In a most preferred form, the projection laterally extends outwardly from one side surface on the tooth proximately midway between the upper and lower surfaces and in a direction generally parallel to the cutting edge extending transversely across the front end of the tooth.

According to still another aspect, there is provided an elongated digging tooth for a two-piece digging tooth assembly adapted to be secured to a transversely extending edge of a bucket or the like. The digging tooth defines a central axis and has a front end, with a cutting edge transversely extending thereacross, a rear end having a blind cavity opening thereto for receiving and accommodating a nose portion of an adapter extending forward from the transversely extending edge of the bucket. The tooth and adapter each define a bore which are arranged in registry with one another after the digging tooth and adapter are conjoined so as to allow a retaining apparatus to pass at least partially through the bores whereby maintaining said tooth and adapter in operable combination with each other. The bore in the tooth defines an axis extending generally normal to the central axis of the tooth. The digging tooth further including an upper surface extending forward and downwardly from the rear end and toward the cutting edge of said digging tooth, and a lower surface extending forward and upwardly from the rearward end and toward the cutting edge of the digging tooth. The digging tooth further includes a generally horizontal projection extending laterally outward from an area on one side of the tooth, with the projection having upper and lower surfaces preferably disposed between and in other than planar relationship relative to the upper and lower surfaces of the digging tooth. The projection on the tooth is disposed rearward of the axis defined by the bore in the tooth and the rear end of said tooth whereby providing the digging tooth with a progressively widening ground penetration zone for facilitating penetration of the bucket edge.

Preferably, the projection is integrally formed as part of and with the remainder of the tooth. In one form, the projection on the tooth has at least one vertically angled forward facing surface for enhancing the ability of the projection to fracture the ground in advance of and thereby protect the transversely extending edge of the bucket against wear. In one form, the projection is arranged on the tooth in generally symmetrical relation relative to said central axis whereby permitting the tooth to be reversed about said central axis. In a most preferred form, the projection laterally extends outwardly from one side surface on the tooth proximately midway between said upper and lower surfaces and in a direction generally parallel to the cutting edge extending transversely across the front end of the tooth.

A primary object of the present invention is to provide a winged digging tooth which will provide the bucket of the above general type significant resistence to wear at an economical cost.

Another feature of the present invention relates to the provision of a digging tooth which shall enhance bucket ground penetration capabilities while concomitantly protecting a bucket edge against wear in even highly compacted and/or rocky soil environments.

Another feature of the present invention relates to providing a bucket with a new and preferably sharpened cutting edge each time the digging teeth are replaced.

Another object of the present invention is to provide a winged digging tooth configured to shield those components disposed rearwardly of the digging tooth against wear.

Another object of the invention is to provide a winged digging tooth extending forward from a bucket edge whereby taking the brunt of the initial digging force while providing a gradually widening ground penetration zone to facilitate ground penetration of the bucket edge.

Still another feature of the present invention relates to providing a ground engaging tooth which offers low cost replaceable protection to a bucket edge of any desired dimensions while also increasing bucket capacity.

Yet another feature of the present invention relates to the provision of numerous digging tooth assemblies laterally spaced in side-by-side relation across an edge of an earth moving bucket and wherein each digging tooth assembly includes an adapter with a replaceable digging tooth extending therefrom, and wherein the digging teeth, in combination with each other, protect and form a swept back, sharpened edge extending forward of and extending across the edge of the earth moving bucket.

Still another feature of the present invention relates to a digging tooth having wing structure which is configured to cradle, support and guide a retaining apparatus relative to an opening in the tooth through which the retaining apparatus lengthwise passes.

Still another feature of the present invention relates to a digging tooth which is configured to compress a flex-pin type retaining apparatus prior to insertion of the retaining apparatus into retaining apparatus receiving bore of an adapter forming part of a two-part digging tooth system.

Yet another feature of the present invention relates to a digging tooth which is configured to protect opposed ends of a retaining apparatus extending beyond the outer surfaces on the digging tooth.

Another feature of the present invention relates to a digging tooth which, following complete insertion of the retaining apparatus thereinto, is preferably designed and configured to inhibit inadvertent shifting of the retaining apparatus relative to the digging tooth or adapter.

These and other numerous objects aims and advantages of the present invention will become readily apparent from the following detailed description and drawings.

DETAILED DESCRIPTION OF THE INVENTION

Figure 1:
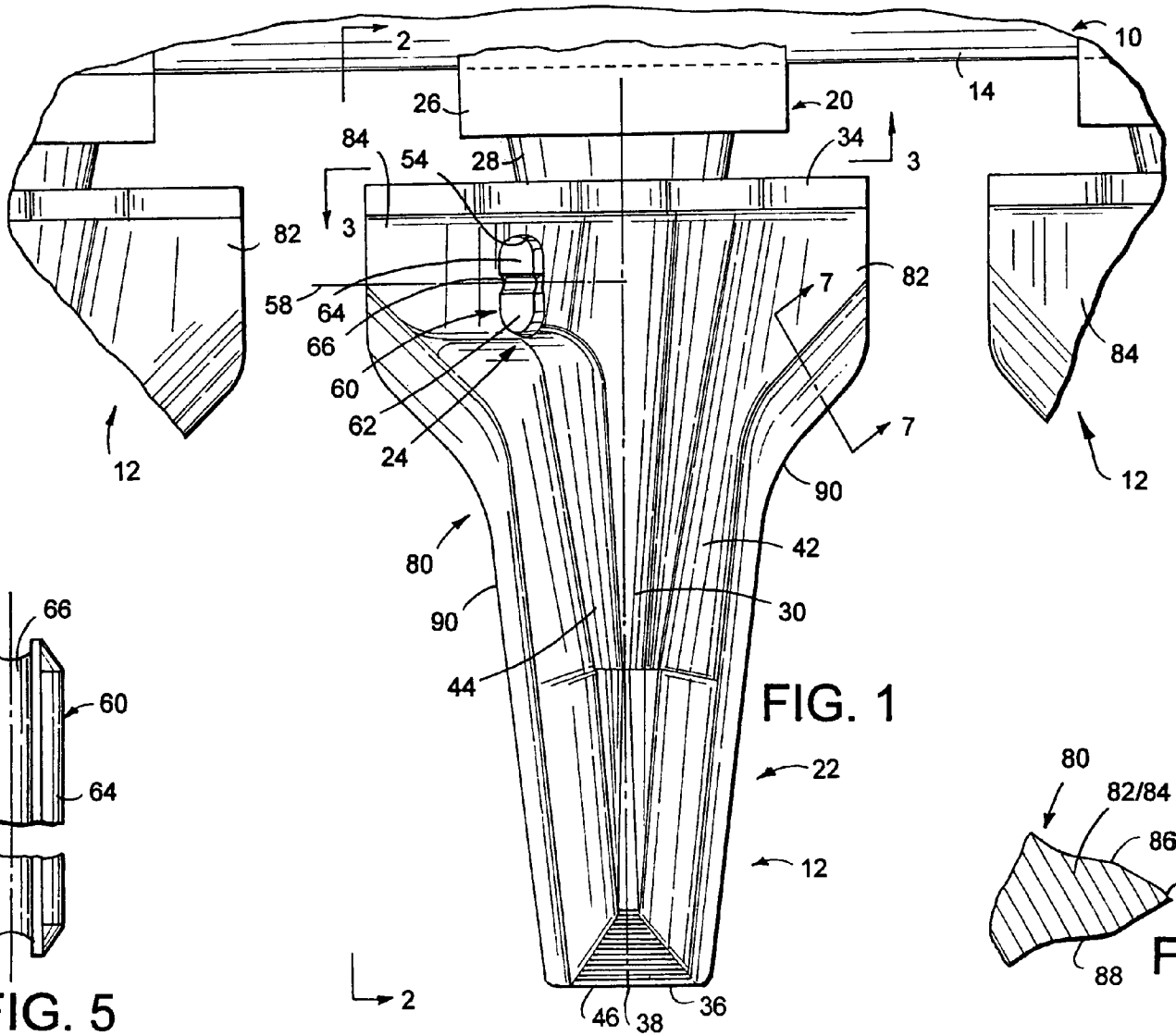
FIG. 1 is fragmentary top plan view of a bucket edge with a series of digging tooth assemblies, embodying principals of the present invention, attached thereto.

The present invention is susceptible of embodiment in multiple forms and there is shown in the drawings and will hereinafter be described various embodiments of the invention, with the understanding the present disclosure sets forth exemplifications of the invention which are not intended to limit the invention to the specific embodiments illustrated and described.

Referring now to the drawings, wherein like reference numerals indicate like parts throughout the several views, there is shown a ground engaging implement, such as a bucket or the like, generally indicated by numeral 10, with a series of digging tooth assemblies 12 arranged in side-by-side relation relative to each other. Bucket 10 is of the type commonly arranged in combination with a backhoe, front loader, excavator or related earth working implement. As shown, bucket 10 includes a base edge or lip 14 extending across and typically welded to the remainder of the bucket 10. As will be appreciated, the leading bucket edge or lip 14 is usually of one-piece construction and can have varying lengths depending upon the particular application.

Figure 2:
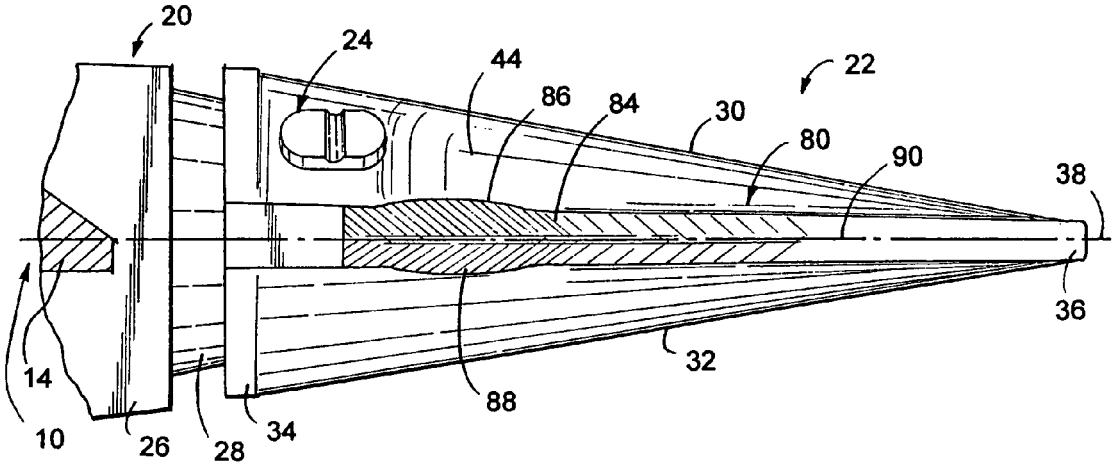
FIG. 2 is a sectional view taken along line 2—2 of FIG. 1.

Each digging tooth assembly 12 extends forward from the bucket edge 14 to fracture, penetrate, and trench the ground material in advance of and thereby promote penetration of the bucket edge 14 into the ground. Typically, and with the exception of the digging tooth assemblies disposed toward opposite corners of the bucket 10, the majority of tooth assemblies 12 are of similar construction relative to each other. Accordingly, only one digging tooth assembly 12 will be discussed in detail. As shown in FIG. 2, each digging tooth assembly 12 is preferably configured as a two-part system including an adapter 20 and a replaceable point or digging tooth 22. The adapter 20 and digging tooth 22 are releasably maintained in operable combination relative to each other by a suitable retaining apparatus 24.

Figure 3:
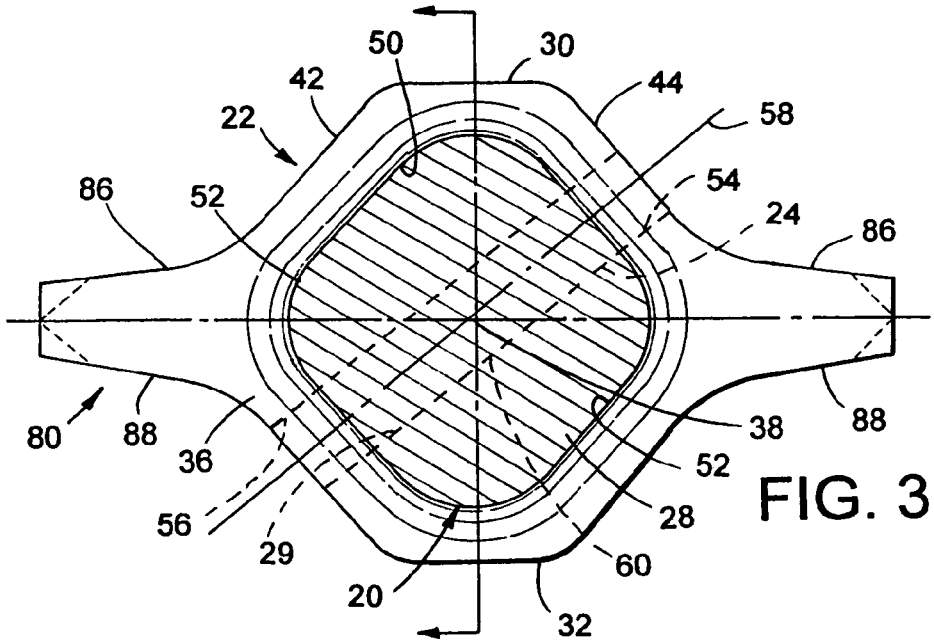
FIG. 3 is a sectional view taken along line 3—3 of FIG. 1.

Adapter 20 is preferably of one-piece construction and has an elongated free ended configuration. More specifically, adapter 20 includes a base portion 26 and a nose portion 28. Base portion 26 is configured for suitable attachment to the bucket edge 14 with nose portion 28 extending forward therefrom. It is not uncommon in the industry to attach the adapter base portion 26 to the bucket edge 14 as by welding. As shown in FIG. 3, the adapter nose portion 28 defines a throughbore or hole 29 provided toward one end thereof.

Each digging tooth 22 has an elongated generally wedge shaped configuration including a first or upper surface 30 and a second or lower surface 32 (FIG. 2). As shown in FIG. 2, the upper surface 30 of tooth 22 extends forward and downwardly from a rear or mounting end 34 toward the forward end 36 of the tooth 22. The lower surface 32 of tooth 22 extends forward and upwardly from the rear mounting end 34 toward the forward end 36 of the tooth 22. In the illustrated embodiment, the rear mounting end 34 and forward end 36 of tooth 22 are axially aligned along a longitudinal centerline 38 of the tooth 22.

Figure 4:
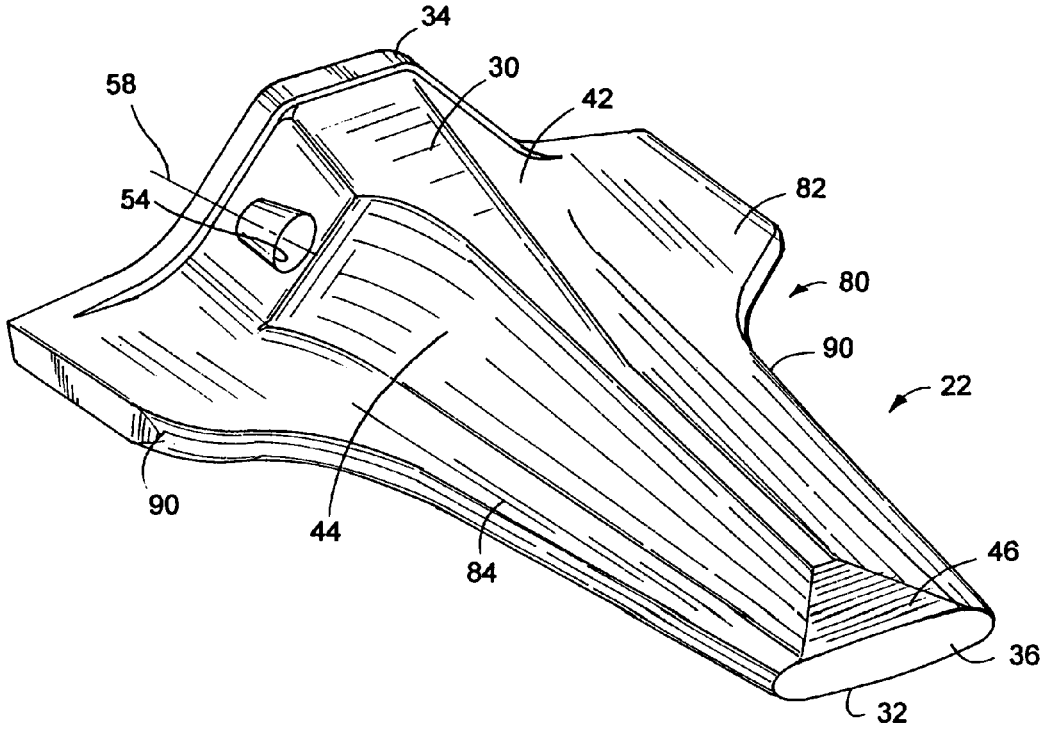
FIG. 4 is a perspective view of a digging tooth embodying principals of the present invention.

As shown in FIG. 3, the ground engaging or digging tooth 22 further includes a pair of laterally spaced side surfaces 42 and 44. Moreover, and as shown in FIGS. 1 and 4, each digging tooth 22 defines a cutting or ground penetrating edge 46 extending transversely across the forward end 36 of the tooth 22. Returning to FIG. 3, to allow the replaceable digging tooth 22 to be mounted in operable combination with adapter 20, a blind cavity or socket 50 is defined by and opens to the rear end 34 of each ground engaging tooth 22.

In a preferred embodiment, the cavity or socket 50, is substantially centered on the longitudinal centerline 38 of the tooth 22.

The conjuncture between the adapter 20 and the digging tooth 22 can take a myriad of different forms without detracting from the spirit and scope of the invention and, in cross-section, has a closed margin 52 extending thereabout. As will be appreciated, the cross-section of the blind cavity 50 on tooth 22 generally corresponds to the cross-section of the nose-portion 28 of the adapter 20. As such, and when the adapter 20 and digging tooth 22 are assembled in operable combination relative to each other, a lengthwise portion of the adapter nose portion 28 longitudinally extends and is accommodated within the blind cavity 50 on the digging tooth 22.

In the embodiment illustrated in FIGS. 1 through 5, and to enhance the conjuncture between the adapter 20 and the ground engaging tooth 22, the adapter nose portion 28 and the blind cavity 50 defined by the tooth preferably have a unique configuration. As shown, the blind cavity 50 opening to the rear end 34 of tooth 22 has a cross-sectional profile having a generally rhombus-like configuration for a major portion of the longitudinal length thereof. As will be appreciated, the adapter nose portion 28 has a corresponding rhombus-like cross-sectional configuration for a majority of its length. For a more detailed discussion of the advantages and unique features to be realized by providing a rhombus-like configuration to the conjuncture between the adapter nose portion 28 and the digging tooth blind cavity 50, attention is directed to U.S. Pat. Nos. 6,047,487 and 6,247,255; each assigned to H&L Tooth Company, with the relevant portions of each being incorporated herein by reference.

The adapter 20 and digging tooth 22 are preferably designed to accommodate either a vertically disposed or diagonal pin retaining system. Digging tooth 22 includes a throughbore which, in the illustrated embodiment, includes a pair of openings or holes 54, 56 positioned to cooperate with the opening or bore 29 in the adapter nose portion 28 and axially aligned along a diagonal axis 58. In the embodiment illustrated in FIG. 4, axis 58 extends at an angle ranging between about 25° and about 65° relative to the edge 46 transversely extending across the forward or first end 36 of the digging tooth 22. In a most preferred form, axis 58 extends at an angle of about 45° relative to the edge 46 transversely extending across the first end 36 of the digging tooth 22. To facilitate manufacture of the adapter 20 and digging tooth 22, axis 58 extends generally normal to an upper slanted surface on the adapter nose portion 28 and generally perpendicular to the longitudinal axis or centerline 38 (FIG. 1) of the digging tooth 22.

Figure 5:
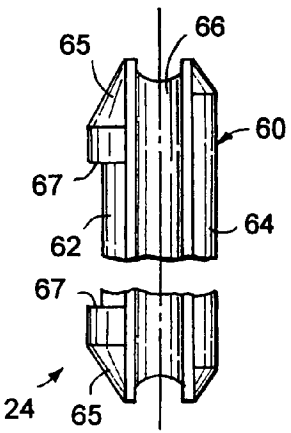
FIG. 5 is a side elevational view of one form of retaining apparatus used in combination with the present invention.

The apparatus 24 for maintaining the adapter 20 and digging tooth 22 in operable combination can also take various forms without detracting or departing from the spirt and scope of the present invention. In the embodiment shown in FIG. 1, apparatus 24 includes an elongated flex-pin structure 60. The flex-pin retainer 60 is typically elliptical in cross-section and, as shown in FIG. 5, includes a first pin half or elongate member 62 and a second half or elongate member 64 joined in a conventional manner by a hard yet compressible elastomer 66 secured therebetween. The pin half 62 has a beveled end portion 65 at opposite ends thereof. Suffice it to say, the flex-pin retainer 60 presents a blunt surface at opposed ends and to the hammer or other tool (not shown) used to drive the flex-pin 60 through either opening 54 and 56 (FIG. 3) and into the bore 29 in the adapter. The exterior diameter of pin half 62 is abruptly reduced below the beveled end portion to create a radial shoulder 67 at each end of the flex-pin 60. As is known, and when the flex-pin 60 is fully inserted through either opening 54, 56 into the bore 29 in the adapter 20, the lengthwise distance between the radial shoulders 67 is sized to releasably retain the pin 60 within the bore 29 in the adapter 20 while the remaining lengthwise portion of the pin 60 will abut against the tooth 22 at the interior edge of the openings 54, 56.

Figure 6:
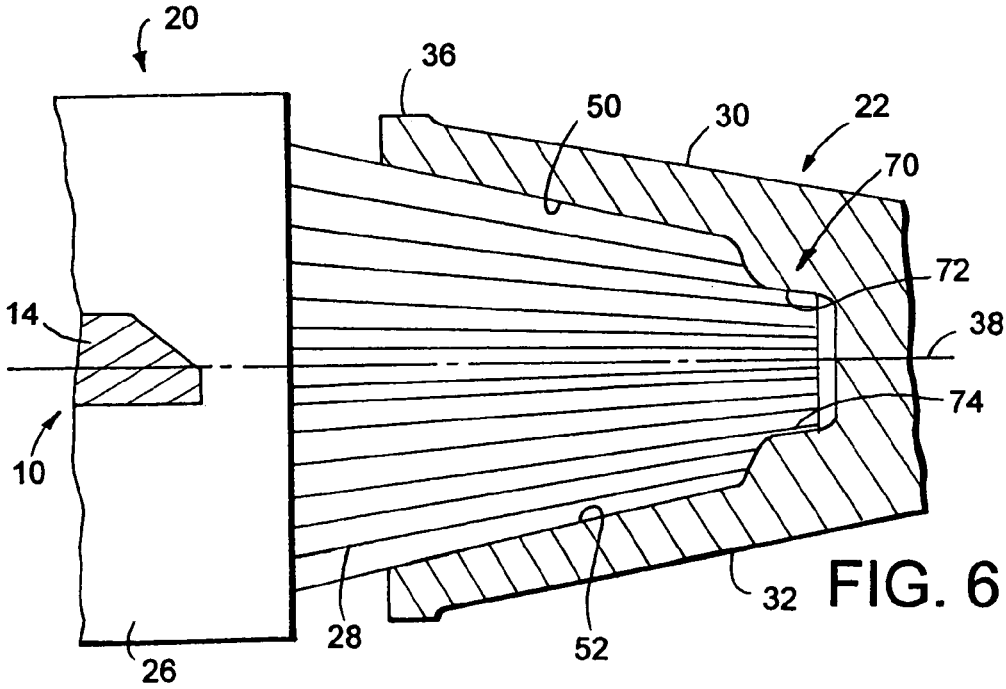
FIG. 6 is a fragmentary sectional view taken along line 6—6 of FIG. 3.

In the embodiment shown in FIG. 6, the digging tooth 22 is furthermore provided with stabilizing structure 70 arranged within and toward the closed end of the blind cavity 50. As shown, stabilizing structure 70 includes a pair of spaced, generally flat stabilizing lands 72 and 74 which, after the ground engaging tooth 22 is slidably arranged in operable combination with the adapter nose portion 28, are adapted to cooperate with complimentary structure on the adapter nose portion 28 whereby adding stability to the digging tooth 22 during a digging operation.

According to the present invention, and as shown in FIGS. 1, 3 and 4, the digging tooth 22 further includes wing structure 80 preferably including first and second wings 82 and 84 projecting laterally outwardly from the sides 42 and 44, respectively, of the digging tooth 22. The purpose of the wing structure 80 is multifold. That is, wing structure 80 serves to shield and protect ground engaging components disposed rearwardly of the rear end 34 of the digging tooth 22 against wear. Second, the wing structure 80 serves to gradually and significantly widen the ground penetration zone provided by each digging tooth assembly 12. Moreover, wing structure 80 enhances the penetration capability of the bucket edge 14 into the ground while concomitantly reducing the energy required to effect such ends. Moreover, and when viewed in combination relative to each other, the cumulative effect of the wing structure 80 on the digging teeth 22 extending laterally across the bucket edge 14 can enhance bucket payload.

In the illustrated embodiment shown, wing structure 80 including wings 82, 84 is preferably formed integral with the reminder of the digging tooth 22. In one form, each wing 82, 84 is designed such that a dynamic or longitudinally swept back configuration is provided to the tooth 22. In the embodiment illustrated in FIGS 1 and 4, each wing 82, 84 extending laterally outward from the side surfaces 42, 44, respectively, has a rear laterally widened portion 86, a laterally narrowed forward or front portion 88, and an outer edge 90 extending therebetween.

Preferably, each wing 82, 84 has a longitudinally swept back design for a major portion of the length of the tooth 22 between the front and rear ends 36 and 34, respectively, thereof. That is, in one form, each wing 82, 84 is designed to have a longitudinally swept back configuration for more than one half the overall length of the tooth such that ground engaging or digging tooth 22 of assembly 12 has a gradually widening ground penetration zone for initially fracturing the ground engaged by the tooth in advance of the bucket edge 14. Slanting or reducing the width or lateral outward extension of the wings 82, 84 toward their forward ends minimizes the force required for initial penetration of the digging tooth 22 while the elongated dynamic or swept back winged design furthermore facilitates ground penetration while furthermore permitting the digging tooth to continually and gradually widen the penetration zone for each digging tooth 22 whereby enhancing the ground penetration capability for the bucket 10. Although in a preferred embodiment the wings 82, 84 longitudinally extend for a major lengthwise portion along opposed side surfaces 42, 44, respectively, of the digging tooth 22, it should be appreciated the wings 82, 84 could have a length less than that shown while extending between the rear and forward ends 34, 36 of the tooth 22 without detracting or departing from the spirit and scope of the invention.

The outer edge 90 of each wing 82, 84 can also have different designs along the length thereof without detracting or departing from the spirit and scope of this invention. In the embodiment shown in FIGS. 1 and 4, edge 90 has a step-like profiled configuration between opposed ends of each wing 82, 84. In the illustrated form, the rear portion of the edge 90 of each wing 82, 84 preferably extends in generally parallel relation to the centerline axis 38 of the digging tooth 22 for a longitudinal distance ranging between about one-third and one-half the overall distance between the rear end 36 and forward end 34 of the digging tooth 22. Thereafter, the outer wing edge 90 laterally converges toward the central axis 38 of the tooth 22. Notably, the edge portion extending along the laterally narrowed portion 88 of each wing 82, 84 extends in generally parallel relation relative to the side surface of the tooth 22 from which the wing laterally extends. As such, and for a major portion of the length of each outer edge 90, the wing edges of laterally adjacent digging teeth extending from the leading edge of the bucket diverge relative to each other. As shown, the profile on the edges of wings 82, 84 preferably provide the tooth 22 with the swept back or dynamic-design promoting movement of the winged tooth 22 through the ground. With this design, and as the wings 82, 84 wear, the preferable step-like profiled configuration extending along the outer edge 90 allows the wings 82, 84 to maintain a gradual but significantly widened penetration zone as the digging tooth 22 moves through the ground.

As shown in FIG. 3, a rear portion of each wing 82, 84, extending laterally from a respective side surface on the digging tooth 22, has a generally planar first or upper surface 92 and a generally planar second or lower surface 92 extending toward the outer edge 90. Preferably, the upper surface 92, of each wing or projection 82, 84 is disposed between the upper and lower surfaces 30 and 32, respectively, of the tooth 22 and in other than a planar relationship relative to the upper surface 30, on the digging tooth 22. In the most preferred form, the lower surface 94 of each wing 82. 84 is disposed between the upper and lower surfaces 30 and 32. respectively, of the tooth 22 and in other than a planar relationship relative to the lower surface 32 on the digging tooth 22. In the preferred form, each projection 82, 84 extends laterally outward from an area on the respective side surface of the tooth 22 disposed proximately midway between the upper and lower surfaces 30, 32, respectively, of tooth 22. That section of the outer edge 90 arranged linearly proximate to the rear of each wing, and as shown in FIG. 5, is preferably configured to promote the entrapment of dirt fines between the wings of laterally adjacent teeth 22 and the bucket edge 14. The entrapment of such dirt fines further promotes protection of the exposed portion of the bucket edge 14.

In one embodiment, the remaining linear edge portion of each wing 82, 84 is preferably designed to promote ground penetration of the tooth 22. That is, the lateral extreme of each wing 82, 84 is preferably provided with first and second edges 96 and 98 (FIG. 3), respectively, angling or converging relative to each other to provide the remaining portion of the edge 90 of each wing 82, 84 with a sharpened or knife-like configuration whereby promoting the ability of the wings 82, 84 to slice, penetrate and fracture the ground ahead of the leading bucket edge 14.

Hundreds of thousands of two-piece digging tooth systems having a digging tooth with a generally rectangular pocket or blind cavity and a rectangularly shaped nose portion on the adapter along with a generally horizontally disposed retaining apparatus already exist and are being widely used daily in the industry. As such, FIGS. 8 through 16 illustrate an alternative form of digging tooth which can readily be used in combination with the more conventional two-part digging tooth systems. This alternative form of digging tooth is designated generally by reference numeral 122 in FIGS. 8 through 16. The elements of this alternative digging tooth that are functionally analogous to those components discussed above regarding digging tooth 22 are designated by reference numerals identical to those listed above with the exception this embodiment uses reference numerals in the 100 series.

Figure 8:
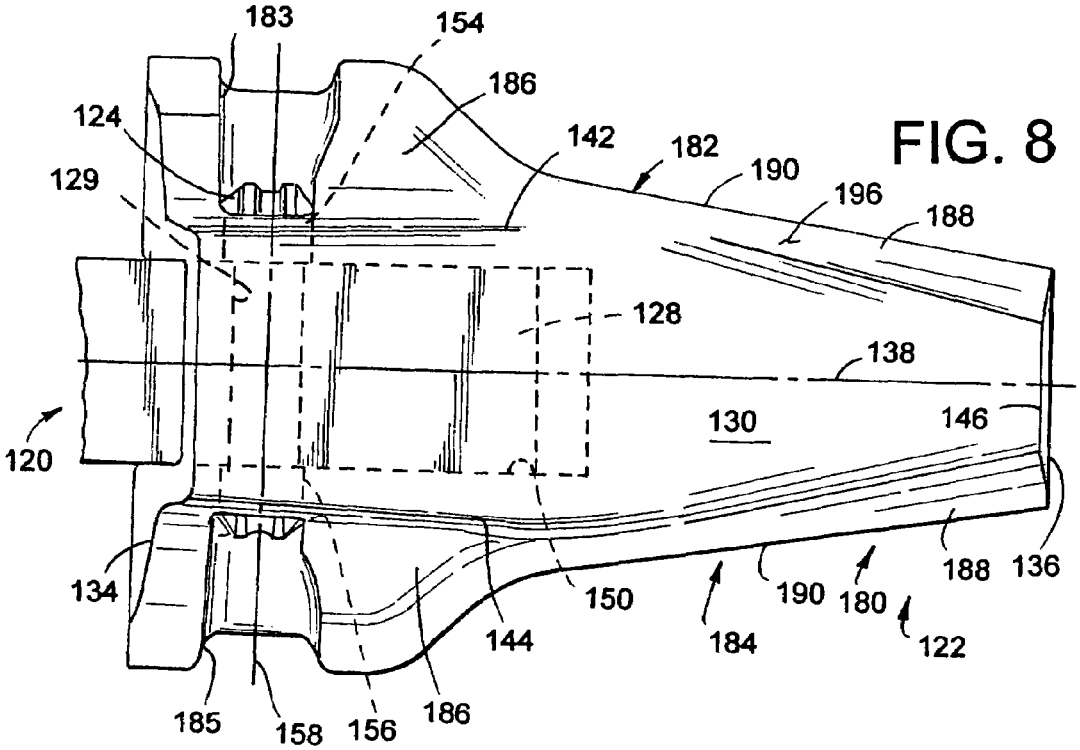
FIG. 8 is a top plan view of an alternative form of the present invention.

As shown in FIG. 8, the digging tooth 122 is configured for use with an adapter 120 with a nose portion 128 extending forward from an edge of an implement or bucket, as described above, and having a well known and widely used generally rectangular cross-sectional configuration. That is, the adapter 120 further includes a conventional mounting portion (not shown) configured to suitably attach the adapter 120 to the edge of the bucket or the like.

Figure 9:
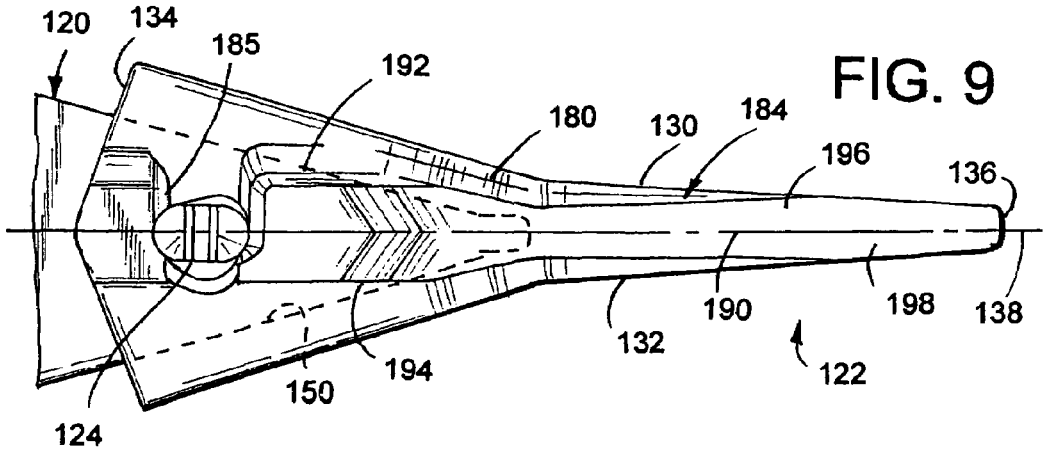
FIG. 9 is a side view of that embodiment of the invention illustrated in FIG. 8.

Digging tooth 122 has an elongated generally wedge shaped configuration including a first or upper surface 130 and a second or lower surface 132 (FIG. 9). As shown in FIG. 9, the upper surface 130 of tooth 122 extends forward and downwardly from a rear or mounting end 134 toward the forward end 136 of the tooth 122. The lower surface 132 of tooth 122 extends forward and upwardly from the rear mounting end 134 toward the forward end 136 of the tooth 22. In the embodiment illustrated in FIG. 7, the rear mounting end 134 and forward end 136 of tooth 122 are axially aligned along a longitudinal centerline 138 of the tooth 122.

Figure 10:
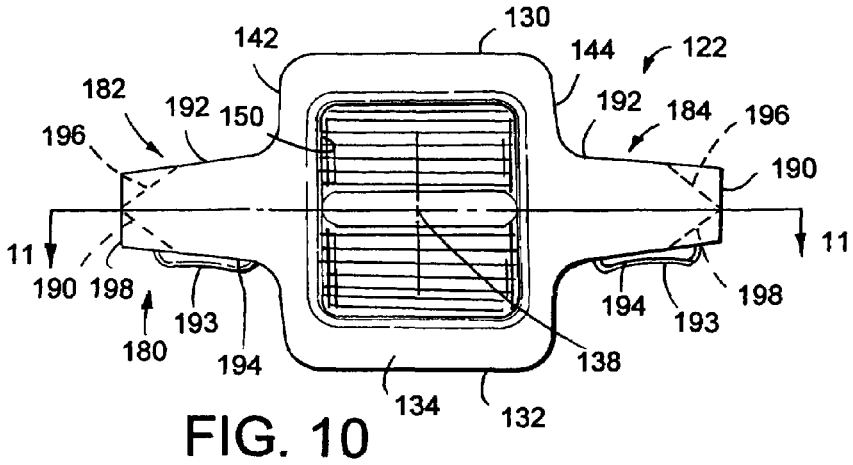
FIG. 10 is a rear view of that embodiment of the invention illustrated in FIG. 8.

Returning to FIG. 8, the ground engaging or digging tooth 122 further includes a pair of laterally spaced side surfaces 142 and 144. Digging tooth 122 further includes a cutting or ground penetrating edge 146 extending transversely across the forward end 136 thereof. Turning to FIG. 9, and to allow the tooth 122 to be mounted in operable combination with adapter 120, a blind cavity or socket 150 is defined by and opens to the rear end 134 of the tooth 122. In a preferred embodiment, the cavity or socket 150, defined by and opening to the rear 134 of the digging tooth 122, is substantially centered on the longitudinal centerline 138 of the tooth 122. As shown in FIG. 10, the cavity or socket has a generally rectangular configuration which compliments the cross-sectional configuration of the adapter nose portion 128 whereby allowing adapter 120 and digging tooth 122 to be assembled in operable combination relative to each other, with a lengthwise portion of the adapter nose portion 128 (FIG. 8) longitudinally extending and being accommodated within the blind cavity 150 on the digging tooth 122.

According to the present invention, and as shown in FIGS. 8 and 10, tooth 122 is further provided with wing structure 180 preferably including first and second wings 182 and 184 projecting laterally outwardly from the side surfaces 142 and 144, respectively, of the digging tooth 122. In the same sense as wing structure 80 described above, the wing structure 180 on the digging tooth 122 serves to shield and protect ground engaging components disposed rearwardly of the rear end 134 of the digging tooth 122 against wear. Moreover, the wing structure 180 serves to significantly widen the ground penetration zone provided by the digging tooth 122 as, thus, also serves to enhance the penetration capability of the bucket edge into the ground while concomitantly reducing the energy required to effect such ends.

Each wing 182, 184 comprising wing structure 180 is preferably formed integral with the reminder of the digging tooth 122. Moreover, each wing 182, 184 is preferably designed and configured such that a dynamic or longitudinally swept back configuration is provided to the digging tooth 122. In the embodiment illustrated in FIG. 8, each wing 182, 184 extends laterally outward from the respective side surface 142, 144 of the tooth 122 and has a rear laterally widened portion 186, a laterally narrowed forward or front portion 188, with an outer edge 190 extending therebetween. In the illustrated embodiment, and while having sufficient strength to serve the purpose of which it is designed, each projection or wing 182, 184 has a relatively narrow vertical width, especially toward a forward end thereof, to promote ground penetration as the tooth is driven and moves horizontally through the ground.

Preferably, each wing 182, 184 has a longitudinally swept back design for a major portion of the length of the tooth 122 between the front and rear ends 136 and 134, respectively, thereof. That is, in the form shown in FIG. 8, each wing 182, 184 is preferably designed to have a longitudinally swept back configuration for more than one half the overall length of the tooth such that the ground engaging or digging tooth 122 has a gradually widening ground penetration zone for initially fracturing the ground engaged by the tooth in advance of the bucket edge.

As discussed regarding digging tooth 22, the outer edge 190 of each wing 182, 184 can have different designs along the length thereof without detracting or departing from the spirit and scope of this invention. In the embodiment shown in FIG. 8, the outer edge 190 preferably has a step-like profiled configuration between opposed ends of each wing 182, 184. In the illustrated form, a rear portion of the outer edge 190 of each wing 182, 184 preferably extends in generally parallel relation to the centerline axis 138 of the digging tooth 122 for a longitudinal distance ranging between about one-third and one-half the overall distance between ends 134 and 136 of the digging tooth 122. Thereafter, the edge 190 of each wing laterally converges toward the centerline 138 of the digging tooth. Notably, the portion of edge 190 extending along the laterally narrowed portion 188 of each wing 182, 184 extends in generally parallel relation relative to the respective side surface of the tooth 122 from which the wing laterally extends. As such, and for a major portion of the length of each outer edge 190, the wing edges on laterally adjacent digging teeth angle away from each other. Suffice it to say, the outer profile on the wings 182, 184 forming wing structure 180 preferably provides the digging tooth 122 with the swept back or dynamic design promoting movement of the winged tooth 22 through the ground.

As shown in FIG. 10, a rear portion of each wing 182, 184, extending laterally from a respective side surface on the digging tooth 122, has a generally planar first or upper surface 192 and a generally planar second or lower surface 194 extending toward the outer edge 190. The upper surface 192 of each wing 182, 184 extends in a direction generally parallel to the cutting edge 146 (FIG. 8) at the forward end 136 of the digging tooth. In that embodiment shown in FIG. 10. the upper surface 192 of each wing or projection 182, 184 is disposed between the upper and lower surfaces 130 and 132. respectively, on the digging tooth 122 and in other than planar relationship relative to the upper surface 130, 132 on the digging tooth 122. Moreover, and in that embodiment illustrated in FIG. 10. the lower surface 194 of each wing or projection 182. 184 is disposed between the upper and lower surfaces 130 and 132. respectively, of the tooth 122 and in other than a planar relationship relative to the lower surface 132 of the tooth 122. In the preferred form, each projection 182, 84 extends laterally outward from an area on the respective side surface of the tooth 122 disposed proximately midway between the upper and lower surfaces 130, 132, respectively, of tooth 122. That section of the outer edge 190 linearly proximate to the rear of each wing, and as shown in FIG. 10, is preferably configured to promote the entrapment of dirt fines between the wings of laterally adjacent teeth and the bucket edge to further promote protection of the exposed portion of the bucket edge.

In the embodiment shown, the remaining linear edge portion of each wing 182, 184 is preferably designed to promote ground penetration of the tooth 122. That is, the lateral extreme of each wing 182, 184 is preferably provided with first and second chamferred edges 196 and 198, respectively, angling or converging relative to each other to provide the remaining edge portion of each wing 182, 184 with a sharpened or knife-like configuration whereby promoting the ability of the wings 182, 184 to slice, penetrate and fracture the ground of the leading bucket edge 14.

Typically, the conventional adapter 120 illustrated in combination with digging tooth 122 further defines a generally horizontally disposed throughbore 129 (FIG. 8) for accommodating a lengthwise portion of a retaining apparatus 124 used to couple adapter 120 and tooth 122 in operable combination. The digging tooth 122 also has a throughbore defined by a pair of openings 154, 156 aligned along a generally horizontal axis 158 (FIG. 8) extending generally normal to axis 138 and positioned to cooperate with the opening or bore 129 in the adapter to accommodate the retaining apparatus 124 passing generally horizontally therethrough.

Figure 7:
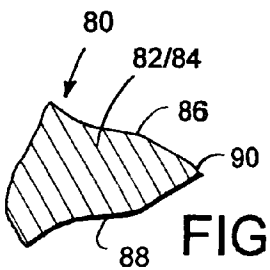
FIG. 7 is a sectional view taken along line 7—7 of FIG. 1.
Figure 11:
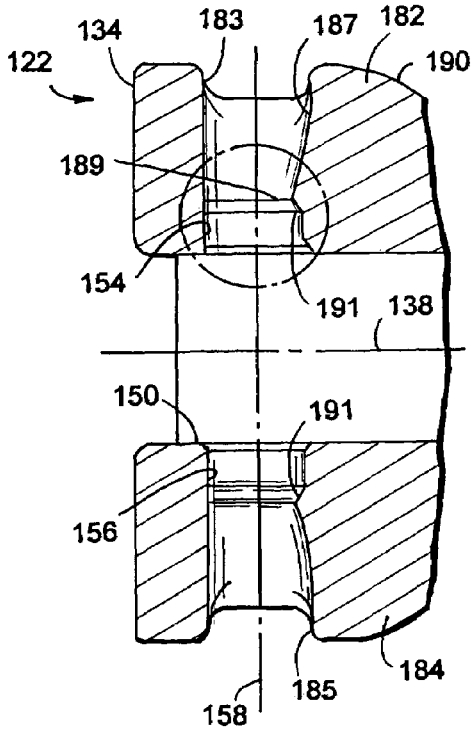
FIG. 11 is a sectional view taken along line 11—11 of FIG. 10.

In the embodiment illustrated in FIGS. 8 and 11, and primarily because the wings 182, 184 preferably extend laterally outwardly from an area on the sides surfaces 142, 144 arranged proximately midway between the upper and lower surfaces 130, 132 (FIG. 9) of the digging tooth, the wings 182 and 184 on the digging tooth 122 further defines a pair of open channels 183 and 185, respectively. The channels 183, 185 on the wings 182, 184, respectively, each have a generally U-shape cross-sectional configuration opening to one of the upper and lower surfaces 192 and 194, respectively, and to the outer edge 190 of the respective wings 182, 184. As shown in FIGS. 7 and 11, the open channels 183, 185 defined by the wing structure 180 on the digging tooth 122 are arranged in generally axial alignment relative to each other and relative to the axis 158 of the openings 154, 156 in the digging tooth 122. To quicken and, thus, enhance the procedure for coupling the adapter 120 and digging tooth 122 in operable combination relative to each other through use of the retaining apparatus 124, the channels 183, 185 on the wings 182, 184 are configured to cradle, support and guide the retaining apparatus 124, regardless of its particular design, when the adapter 120 and tooth 122 are to be joined in operable combination relative to each other.

Some operators prefer using a flex-pin retainer 60 (FIG. 5) for operably securing the adapter 120 and tooth 122 in operable combination relative to each other. As such, and to further quicken and, thus, enhance the procedure for coupling the adapter 120 and digging tooth 122 in operable combination relative to each other through use of a flex-pin retainer 60 the area arranged proximate to each tooth opening 154, 156 is configured to impart compression to and as the flex-pin retainer 60 is inserted into position to maintain the adapter 120 and tooth 122 in operable combination relative to each other. In a preferred form, the channels 183, 185 on digging tooth 122 are mirror images of each other. Thus, a description of only channel 183 will be provided.

Figure 12:
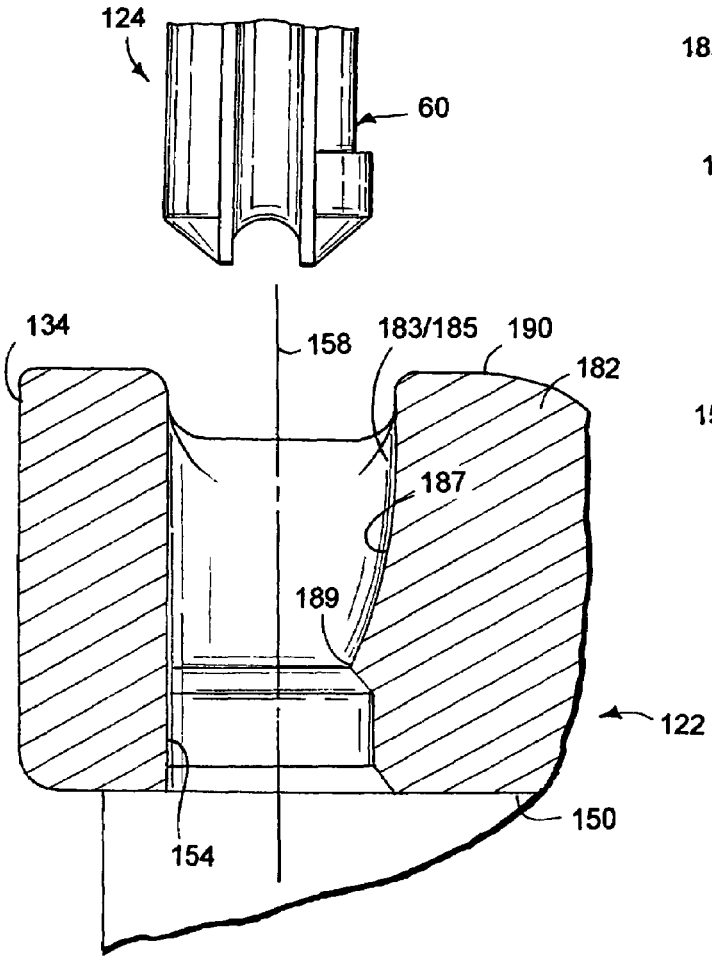
FIG. 12 is an enlarged sectional view of the encircled area of FIG. 11 showing one form of retaining apparatus for insertion into operable association with the digging tooth.

As shown in FIGS. 11 and 12, each open channel 183/185 includes an elongated camming surface 187 extending from the open end of the channel, disposed adjacent to the outer edge 190 of the respective wing, and toward a protrusion 189 disposed between the open end of the channel and the respective bore or hole in the tooth 122 opening to the blind cavity 150. Suffice it to say, the radial protrusion 189 is disposed to radially narrow the size of the passage through which the flex-pin retainer 60 travels or passes along its path to the respective opening or bore in the side of the digging tooth 122. With such design, the inlet end to each channel 183/185 is widened at that end of the respective channel disposed proximate to the outer edge of the wing or projection. Besides yielding benefits when a flex-pin retainer is used, the tapered design of each channel furthermore prevents solids from being driven inward toward the retaining apparatus 124 regardless of the form used. Moreover, the tapered design of each channel allows solids entrapped in the channel from being quickly dislodged therefrom when the retaining apparatus is driven in an outward direction so as to provide a self-cleaning function. Additionally, the tapered design of each channel yield further maneuverability as the retaining apparatus is inserted into and removed from operable association with the adapter and tooth. This advantage is of particular importance when considering the angularity associated with corner digging tooth arrangements.

Figure 13:
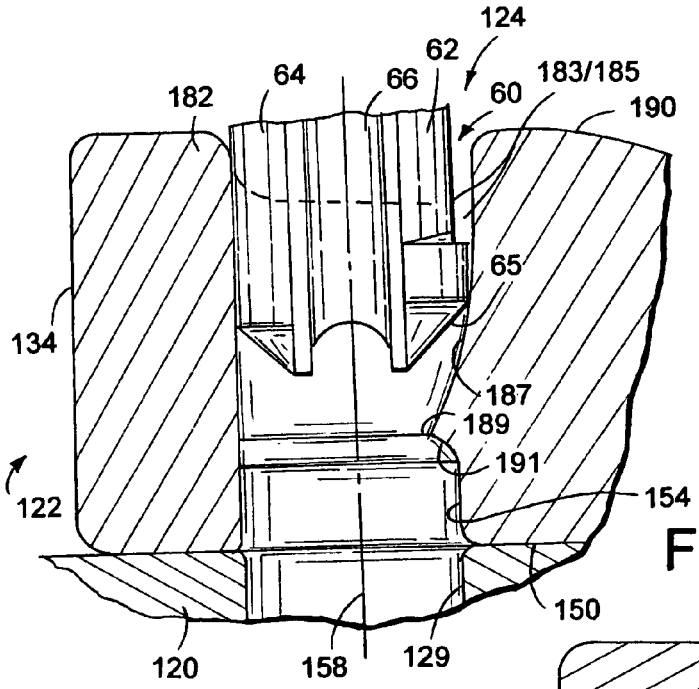
FIG. 13 is an enlarged view similar to FIG. 12 showing the retaining apparatus inserted further into operable association with the digging tooth.

As illustrated in FIG. 13, as retainer 60 is driven along its path to the respective bore in the side of the digging tooth 122, the camming surface 187 of the respective channel 183/185 narrows the retaining pin passage leading to the respective bore in the digging tooth 122. Moreover, as the pin 60 passes along the channeled passage, the camming surface 187 engages with the beveled or chamferred end portion 65 of the flex-pin 60 thereby causing pin half 62 to move toward pin half 64 as through compression of the elastomer material 66 thereby reducing the width of the elliptical retainer 60.

Figure 14:
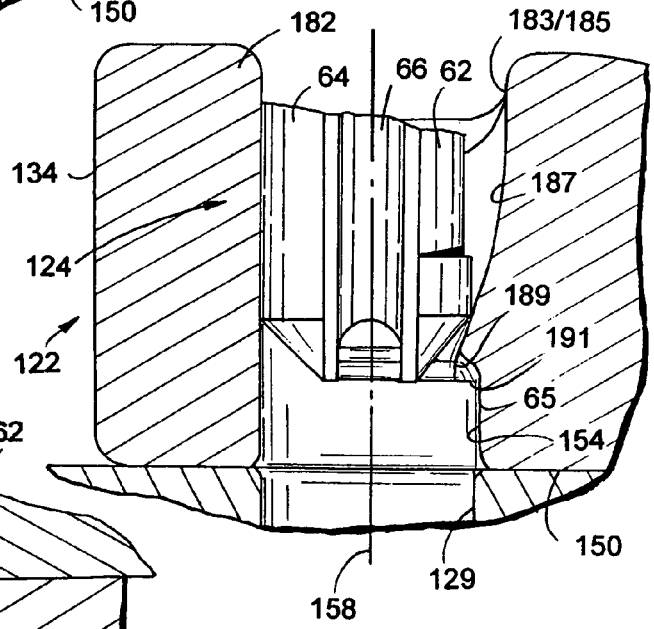
FIG. 14 is an enlarged view similar to FIGS. 12 and 13 showing progressive insertion of the retaining apparatus into further operable association with the digging tooth.

As shown in FIG. 14, and as the retainer 60 continues along its linear path toward the bore 129 in the adapter 120, the beveled or chamferred end portion 65 of the flex-pin retainer 60 engages and moves past the radial protrusion 189. As the flex-pin 60 moves therepast, the radial protrusion 189 causes further radially directed inward movement of the pin half 62 toward pin half 64 and further compression of the elastomer material 66 whereby furthermore reducing the width of the flex-pin 60. As will be appreciated, reducing the width of the flex-pin 60 facilitates entry of the end of the flex-pin 60 into the bore 129 of the adapter 120.

Figure 15:
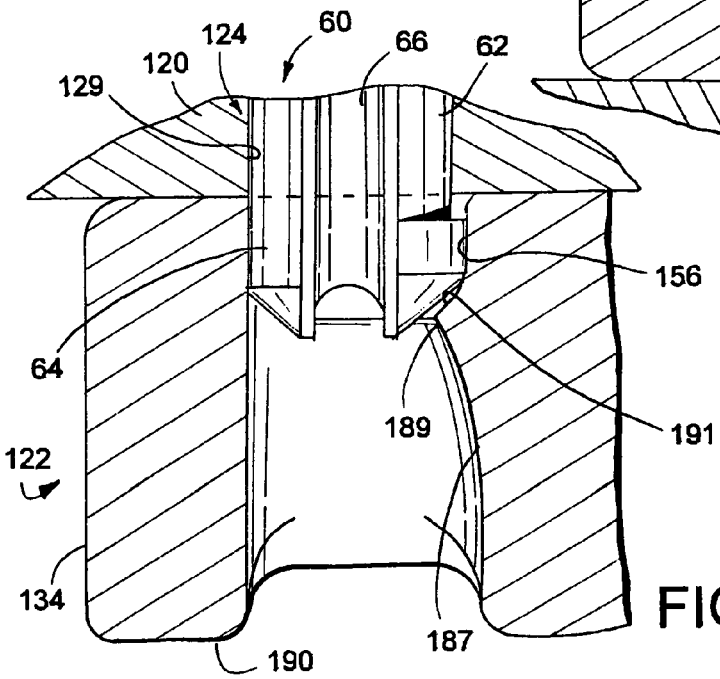
FIG. 15 is an enlarged view of a corresponding but opposite side of the digging tooth following the retaining apparatus being arranged in operable association with the digging tooth.

In a preferred embodiment, the area arranged proximate to each tooth opening 154, 156 (FIG. 11) is also configured to inhibit inadvertent axial shifting of the retaining apparatus 124 relative to the adapter 120 and digging tooth 122 following insertion of the retaining apparatus 124 into operative combination therewith. FIG. 15 shows the flex-pin 60 as being fully inserted into operative combination with the adapter 120 and digging tooth 122. Notably, that portion of the radial protrusion 189 extending toward the opening or hole 154, 156 in the side surface of the tooth 122 is configured with a slanting surface 191 disposed linearly from the chamferred or beveled end portion 65 on the flex-pin retaining apparatus 60 following the flex-pin 60 being fully inserted into operative combination with the adapter 120 and digging tooth 122. As such, and should flex-pin 60 linearly shift during operation of the digging tooth assembly, the chamferred or beveled end portion 65 on the flex-pin retaining apparatus 60 will abut against the surface 191 on the radial protrusion 189 which will thereafter halt further inadvertent linear movement or displacement of the flex-pin 60 relative to either adapter 120 or digging tooth 122.

Figure 16:
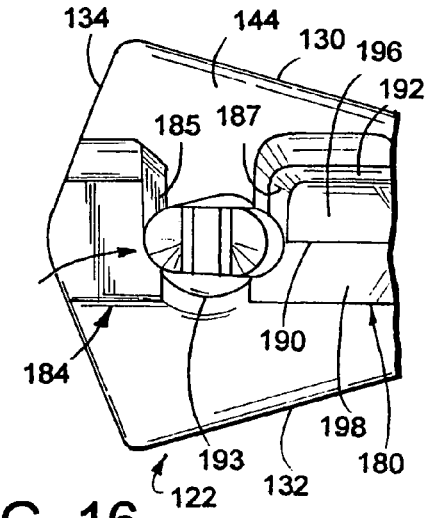
FIG. 16 is a fragmentary side elevational view of the digging tooth illustrated in FIG. 8 and having the retaining apparatus arranged in operable association therewith.

FIGS. 8 and 16 illustrate how the channels 183, 185 protect the free ends of the retaining apparatus 124 extending beyond opposed sides surfaces of the digging tooth 122. That is, configuring wing structure 180 to extend from an area proximately midway between the upper and lower surfaces 130, 132 (FIG. 16) of the digging tooth 122, allows retaining apparatus 124 to be operably embedded in the respective channel of the wing in spaced relation from the wing surface 192, 194 defining the channel and which serves to deflect materials from engaging and otherwise impacting with the free ends of the retaining apparatus 124 safely cradled within the open top channels 183, 185 and, thus, out of direct contact with the materials moving therepast and thereover. Moreover, dirt fines are likely to become entrapped within each channel on the digging tooth thereby further protecting the free ends of the retaining apparatus 124 extending from opposed side surfaces of the tooth 122 from having pin dislocating influences and forces placed thereon during a digging operation.

Each channel 183, 185 provided on the wing structure 180 preferably opens to an upper surface of a respective wing 182, 184, respectively. To maintain structural strength along the entire length of each wing 182, 184 of wing structure 180, and as shown by example in FIGS. 10 and 16, the digging tooth 122 is provided with a strengthening rib or lateral projection 193 underlying an area extending directly beneath each channel 183, 185 and which is configured to impart a minimal affect on the ability of the tooth to move horizontally through the ground.

Figure 17:
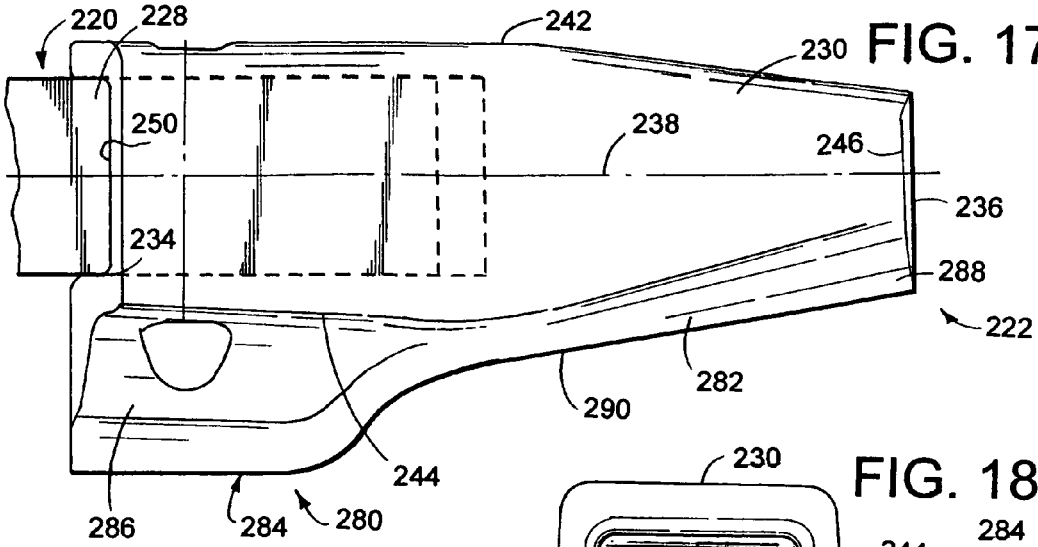
FIG. 17 is a top plan view of another embodiment of the present invention.
Figure 18:
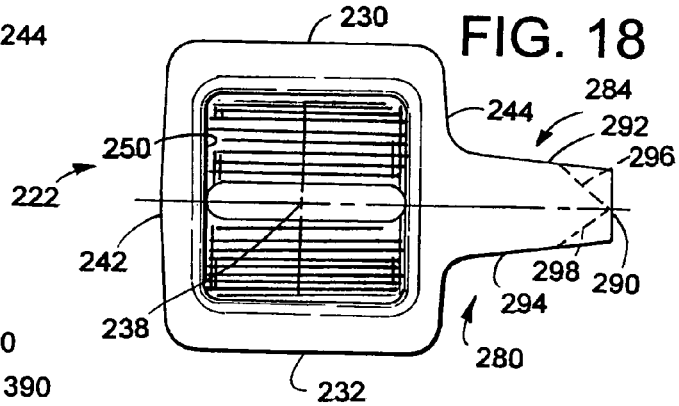
FIG. 18 is a rear view of that embodiment of the invention illustrated in FIG. 17.

To accommodate a corner adapter position on a bucket, the wing structure on the digging tooth can be configured with a single wing design. In this regard, FIGS. 17 and 18 illustrate an alternative form of digging tooth which can readily be used in combination with a corner adapter position. This alternative form of digging tooth is designated generally by reference numeral 222 in FIGS. 17 and 18. The elements of this alternative digging tooth design that are functionally analogous to those components discussed above regarding digging tooth 22 are designated by reference numerals identical to those listed above with the exception this embodiment uses reference numerals in the 200 series.

As shown in FIG. 17, digging tooth 222 is configured for use with an adapter 220 with a nose portion 228 extending forward from an edge of an implement or bucket, as described above. The tooth 222 is operably connected to adapter 220 through use of a conventional retaining apparatus (not shown). Tooth 222 has an elongated generally wedge shaped configuration having an upper surface 230 and a lower surface 232. The first or upper surface 230 downwardly slants from the rear end 234 and toward the forward end 236 of the tooth 222. To promote fracturing of the ground as the tooth moves therethrough, tooth 222 is provided with a cutting edge 246 extending transversely across the forward end 236. The second or lower surface 232 (FIG. 18) slants upward between the ends 234, 236 of the tooth 222. Preferably, the ends 234, 236 of tooth 222 are aligned along a central axis 238.

The ground engaging or digging tooth 222 further includes a pair of laterally spaced side surfaces 242 and 244. Digging tooth 222 further includes a cutting or ground penetrating edge 246 extending transversely across the forward end 236 thereof. To allow the tooth 222 to be mounted in operable combination with adapter 220, a blind cavity or socket 250 is defined by and opens to a rear end 234 of the tooth 222. As will be appreciated, the cavity 250, defined by and opening to the rear 234 of the digging tooth 222, has a cross-sectional configuration which compliments the cross-sectional configuration of the nose portion 228 of adapter 220 whereby allowing adapter 220 and digging tooth 222 to be assembled in operable combination. That is, the cavity 250 defined by tooth 222 can have a generally rhombus-like cross-sectional configuration, a generally rectangular cross-sectional configuration, or any other suitable cross-sectional configuration without detracting or departing from the spirit and scope of the invention.

According to the present invention, and as shown, wing structure 280 is provided on the digging or ground engaging tooth 222. In the illustrated embodiment, wing structure 280 includes a single wing 284 laterally extending outwardly from the side surface 244 of the tooth 222 proximately midway between the upper and lower surfaces 230 and 232, respectively. In the same sense described above, the wing structure 280 serves to shield and protect ground engaging components disposed rearwardly of the rear end 234 of the digging tooth 222 against wear. Moreover, and although only a single wing 284 is provided, such wing 284 serves to significantly widen the ground penetration zone provided by the digging tooth 222. Widening the penetration zone for the digging tooth also serves to enhance the penetration capability of the bucket edge into the ground while concomitantly reducing the energy required to effect such ends.

Wing 284 is preferably formed integral with the reminder of the digging tooth 222. In a preferred form, the wing 284 is arranged on the tooth 222 in generally symmetrical relation relative to the central axis 238 whereby enhancing the versatility of the tooth by allowing it to be reversed about the central axis 238 and, thus, serve on either corner adapter for the bucket. In the embodiment illustrated in FIG. 17, the wing 284 has a rear laterally widened portion 286, a laterally narrowed forward or front portion 288, with an outer edge 290 extending therebetween In the illustrated embodiment, and while having sufficient strength to serve the purpose of which it is designed, the projection or wing 284 has a relatively narrow vertical dimension to promote ground penetration as the tooth moves and is driven horizontally through the ground.

Preferably, wing 284 has a longitudinally swept back design for a major portion of the length of the tooth 222 between the rear and front ends 234 and 236, respectively, thereof. That is, in the form shown in FIG. 17, wing 284 is designed to have a longitudinally swept back configuration for more than one half the overall length of the tooth so as to provide tooth 222 with a gradually widening ground penetration zone for initially fracturing the ground engaged by the tooth 222 in advance of the bucket edge.

As discussed regarding tooth 22, the outer edge 290 of wing 284 can have different designs along the length thereof without detracting or departing from the spirit and scope of this invention. As shown in FIG. 17, wing edge 290 has a step-like profiled configuration between opposed ends of wing 284. The rear portion of the outer edge 290 of wing 284 preferably extends in generally parallel relation to the centerline axis 238 of the digging tooth 222 for a longitudinal distance ranging between about one-third and one-half the overall distance between ends 234 and 236 of the tooth 222. Thereafter, the wing edge 290 laterally converges or angles toward the central axis 238 of the tooth, Notably, that portion of the wing edge 290 extending longitudinally along the laterally narrowed portion 288 of wing 282 extends in generally parallel relation relative to the side surface 244 of the tooth 222 from which wing 284 laterally extends. As such, the preferred slanting configuration of the wing edge 290 provides tooth 222 with the swept back or dynamic design promoting movement of the winged tooth 22 through the ground.

As shown in FIG. 18, a rear portion of wing 284, extending laterally from side surface 244 on the digging tooth 222, has a generally planar first or upper surface 292 and a generally planar second or lower surface 294 extending toward the outer edge 290. The upper surface 292 of wing 284 extends in a direction generally parallel to the cutting edge 246 at the forward end 236 of the digging tooth. That section of the outer edge 290 linearly proximate to the rear of the wing 284, and as shown in FIG. 18, is preferably configured to promote the entrapment of dirt fines between the wings of laterally adjacent teeth and the bucket edge.

In the embodiment shown in FIGS. 17 and 18, the remaining linear edge portion of wing 284 is preferably designed to promote ground penetration of the tooth 222. That is, the lateral extreme of wing 284 is preferably provided with first and second chamferred edges 296 and 298, respectively, angling or converging relative to each other to provide the remaining edge portion of the wing 284 with a sharpened or knife-like configuration whereby promoting the ability of the wing 284 to slice, penetrate and fracture the ground ahead of the leading bucket edge.

Figure 19:
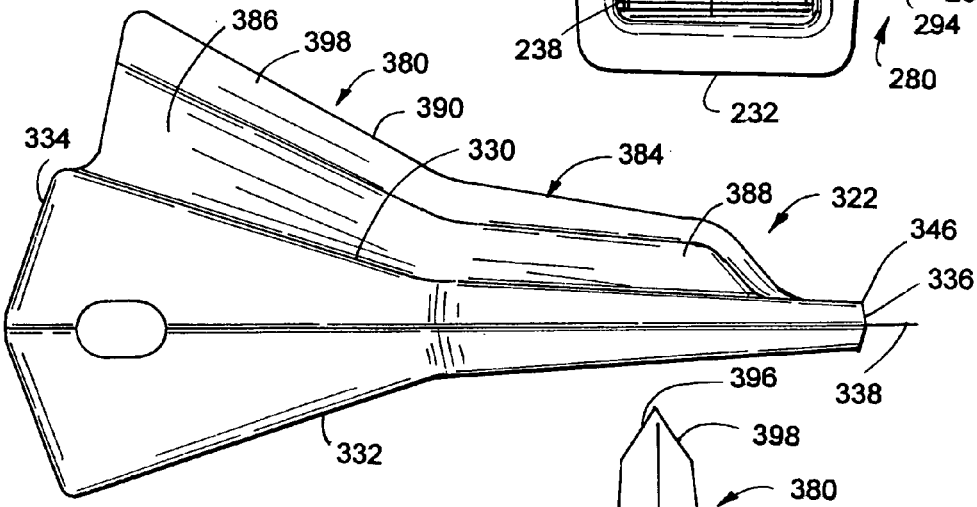
FIG. 19 is a side elevational view of yet another embodiment of the present invention.
Figure 20:
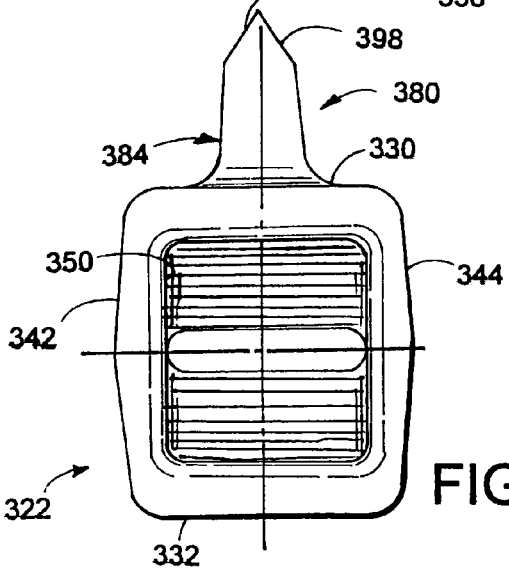
FIG. 20 is a rear view of that embodiment of the invention illustrated in FIG. 19.

FIGS. 19 and 20 illustrate a mining tooth designated generally by reference numeral 322 The elements of this alternative tooth design that are functionally analogous to those components discussed above regarding tooth 22 are designated by reference numerals identical to those listed above with the exception this embodiment uses reference numerals in the 300 series.

As shown, mining tooth 322 has an elongated generally wedge shaped configuration including an upper surface 330 and a lower surface 332. The upper surface 330 downwardly slants from the rear end 334 and toward the forward end 336 of the tooth 322. The lower surface 332 slants upward between the rear and forward ends 334 and 336, respectively. In a one form, the tooth 332 is provided with a cutting edge 346 extending transversely across the front end of the tooth 322. Preferably, the ends 334, 336 of the tooth are aligned along a central axis 338.

The ground engaging or digging tooth 322 further includes a pair of laterally spaced side surfaces 342 and 344. To allow the tooth 322 to be mounted in operable combination with an adapter or support (not shown), a blind cavity or pocket 350 is defined by and opens to a rear end 334 of the tooth 322. As will be appreciated, the cavity 350, defined by and opening to the rear 334 of the digging tooth 322, has a cross-sectional configuration which compliments the cross-sectional configuration of the nose portion of an adapter whereby allowing adapter 320 and digging tooth 322 to be assembled in operable combination. That is, the cavity 350 defined by tooth 322 can have a generally rhombus-like cross-sectional configuration, a generally rectangular cross-sectional configuration, or other suitable cross-sectional configuration without detracting or departing from the spirit and scope of the invention.

As shown, mining tooth 322 is provided with wing structure 380. In this embodiment, the wing structure 380 includes a longitudinally extending wing 384 projecting vertically from the upper surface 330 of the digging tooth 322 proximately midway between the side surfaces 342 and 344, respectively, and in a direction extending generally normal to the transverse cutting edge 346 at the front end 336 of the tooth. In the illustrated embodiment, and while having sufficient strength to serve the purpose of which it is designed, the projection or wing 384 has a relatively narrow lateral width to promote ground penetration as the tooth moves both vertically and horizontally. Providing the wing structure 380 on the tooth 322 is expected to extend the wear life of those wear components, i.e. wear cap, and etc., arranged in operable combination with a two-part digging tooth system of which tooth 322 is configured to serve as an integral part.

Wing 384 of structure 380 is preferably formed integral with the reminder of the digging tooth 322. In that form illustrated in FIGS. 19 and 20, the wing 384 has a rear vertically widened portion 386, a vertically narrowed forward or front portion 388, with an outer edge 390 extending therebetween. Preferably, wing 384 progressively increases in height for a major portion of the length of the tooth 322 between the front and rear ends 336 and 334, respectively, thereof. That is, in the form shown in FIG. 19, wing 384 increases in height for more than one half the overall length of the tooth 322.

In the embodiment shown, the linear edge portion 390 of wing 384 is preferably designed to promote ground penetration of the tooth 322. That is, the vertical extreme of wing 384 is preferably provided with first and second chamferred edges 396 and 398, respectively, angling or converging relative to each other to provide the edge portion of the wing 384 with a sharpened or knife-like configuration whereby promoting the ability of the wing 384 to slice, penetrate and fracture the ground as the tooth 322 is moved both horizontally and vertically.

Figure 21:
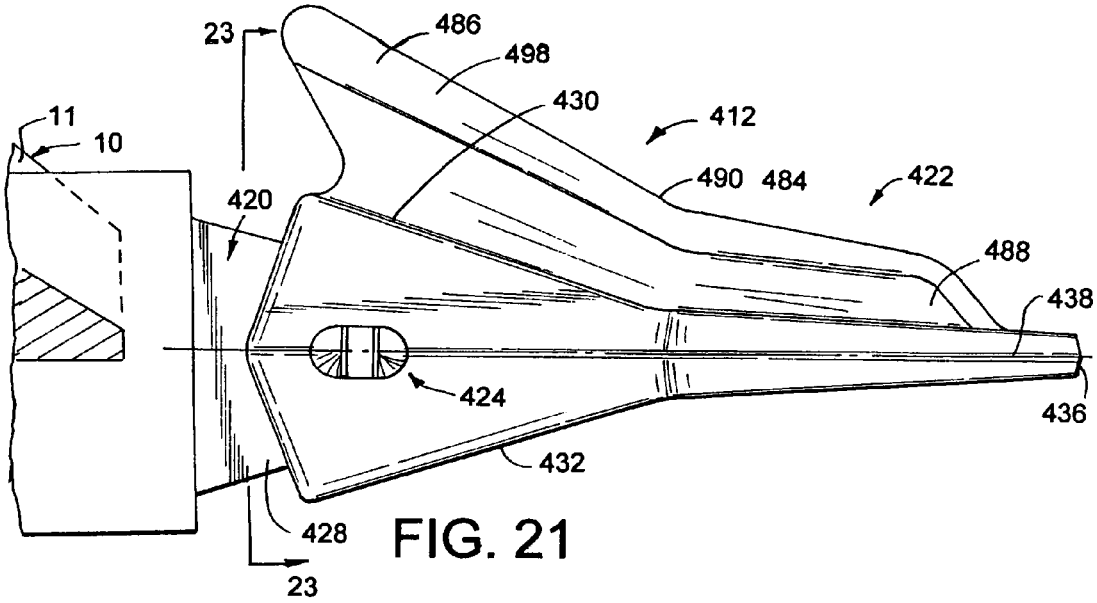
FIG. 21 is a side elevational view of still another embodiment of the present invention.
Figure 22:
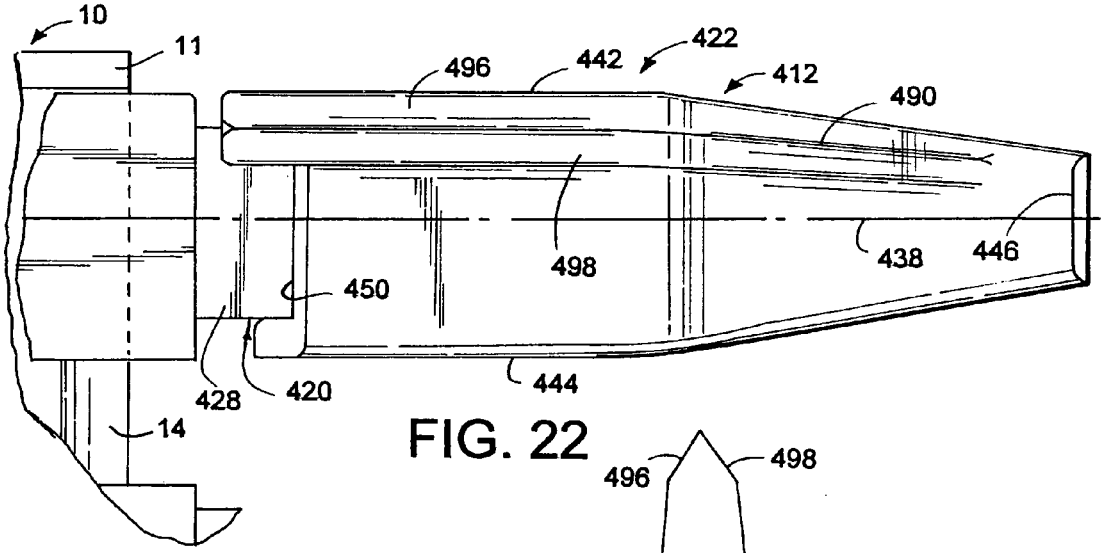
FIG. 22 is a top plan view of that embodiment of the invention illustrated in FIG. 22.
Figure 23:
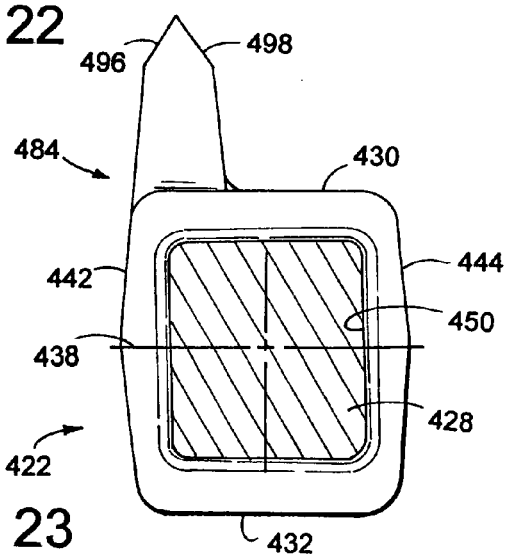
FIG. 23 is a sectional view taken along line 23—23 of FIG. 21.

FIGS. 21, 22 and 23 illustrate a two-part tooth assembly including still another form of tooth designed to shield and/or protect a wear component arranged rearwardly thereof. In this embodiment, the tooth is designed to enhance wear characteristics of a ground engaging portion of a sidewall 11 on a bucket 10 or the like. The tooth illustrated in FIGS. 21, 22 and 23 is designated generally by reference numeral 422. The elements of this alternative digging tooth design that are functionally analogous to those components discussed above regarding digging tooth 22 are designated by reference numerals identical to those listed above with the exception this embodiment uses reference numerals in the 400 series.

As shown in FIGS. 21 and 22, tooth 422 is configured for use with a corner adapter 420 having a nose portion 428 extending forward from an edge 14 of an implement or bucket 10, as described above. The digging tooth 422 is operably connected to the adapter 420 through use of a conventional retaining apparatus 424. Digging tooth 422 has an elongated generally wedge shaped configuration including a first or upper surface 430 and a second or lower surface 432. The upper surface 430 downwardly slants from the rear end 434 and toward the forward end 436 of the tooth 422. The lower surface 432 of tooth 422 is inclined upward between the rear and forward ends 434 and 436, respectively. Preferably, the ends 434, 436 of the tooth are aligned along a central axis 438.

As shown in FIG. 23, tooth 422 further includes laterally spaced side surfaces 442 and 444. Returning to FIG. 21, tooth 422 further includes a cutting or ground penetrating edge 446 extending transversely across the forward end 436 thereof. To allow the tooth 422 to be mounted in operable combination with the corner adapter or support 420, a blind cavity or pocket 450 is defined by and opens to a rear end 434 of the tooth 422. As will be appreciated, the cavity 450, defined by and opening to the rear 434 of the digging tooth 422, has a cross-sectional configuration which compliments the cross-sectional configuration of the nose portion of adapter whereby allowing adapter 420 and digging tooth 422 to be assembled in operable combination. That is, the cavity 450 defined by tooth 422 can have a generally rhombus-like cross-sectional configuration, a generally rectangular cross-sectional configuration, or other suitable cross-sectional configuration without detracting or departing from the spirit and scope of the invention.

According to the present invention, and as shown, tooth 422 includes a longitudinally extending projection 484 extending vertically from the upper surface 430 of the digging tooth 422 in a direction extending generally normal to the edge 446 at the forward end 436 of the tooth 422. In the embodiment depicted in FIGS. 21, 22 and 23, the projection 484 is laterally offset relative to the upper surface 430 of the tooth 422 such that the projection 484 is disposed closer to side surface 442 than it is relative to side surface 444. As will be appreciated, providing the projection 484 proximate to the side surface 442 on the digging tooth serves to shield and, thus, extend the wear life of the wear component, i.e. bucket side wall 11, arranged in rearwardly of the digging tooth 422 on the two-part digging tooth system.

Projection 484 is preferably formed integral with the reminder of the tooth 422. In a preferred form, illustrated in FIG. 21, projection 484 has a rear vertically widened portion 486, a vertically narrowed forward or front portion 488, with an outer edge 490 extending therebetween. Preferably, projection 484 progressively increases in height for a major portion of the length of the tooth 422 between the front and rear ends 436 and 434, respectively, thereof. That is, in the form shown in FIG. 18, projection 484 continues to increase in height for more than one half the overall length of the tooth 422. In the illustrated embodiment, and while having sufficient strength to serve the purpose of which it is designed, the projection 484 has a relatively narrow lateral width to promote ground penetration as the tooth moves both vertically and horizontally.

In the embodiment shown, the linear edge portion of the projection 484 is preferably designed to promote ground penetration of the tooth 422. That is, the extreme vertical edge of the projection 484 is preferably provided with first and second chamferred edges 496 and 498, respectively, angling or converging relative to each other to provide the edge portion of the projection 484 with a sharpened or knife-like configuration whereby promoting the ability of the projection 484 to slice, penetrate and fracture the ground as the tooth 422 is moved both horizontally and vertically through the ground during an operation.

Figure 24:
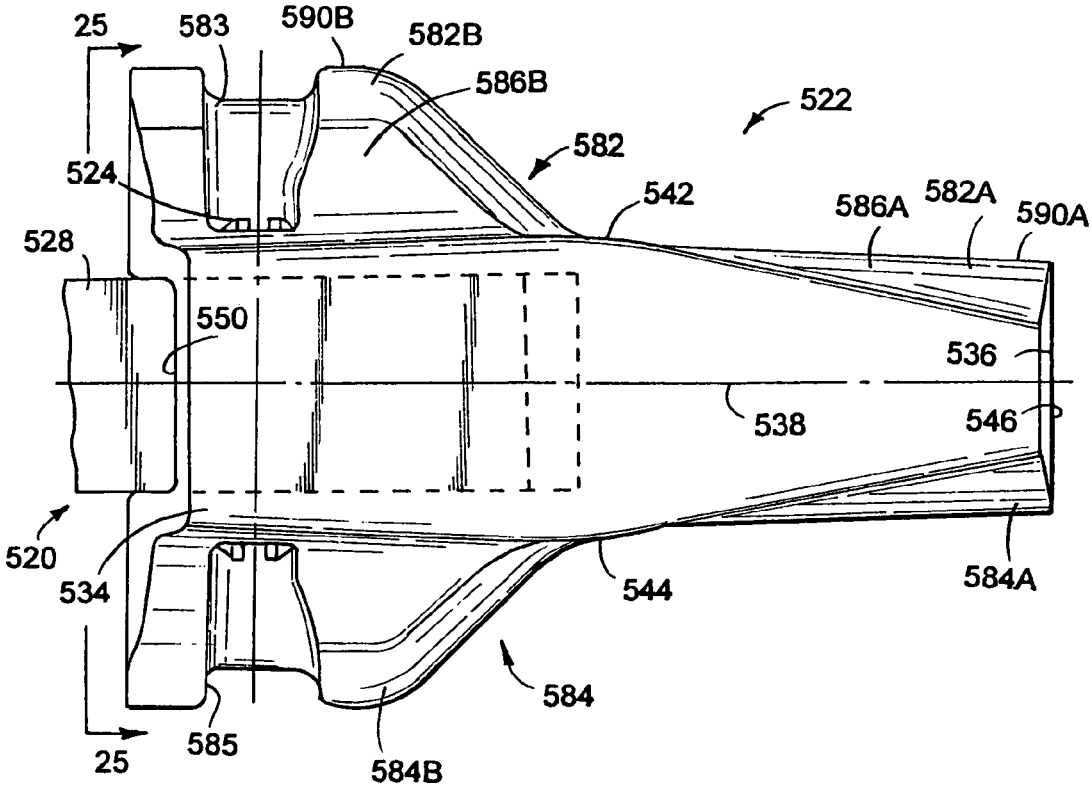
FIG. 24 is a top plan view of another embodiment of the present invention.
Figure 25:
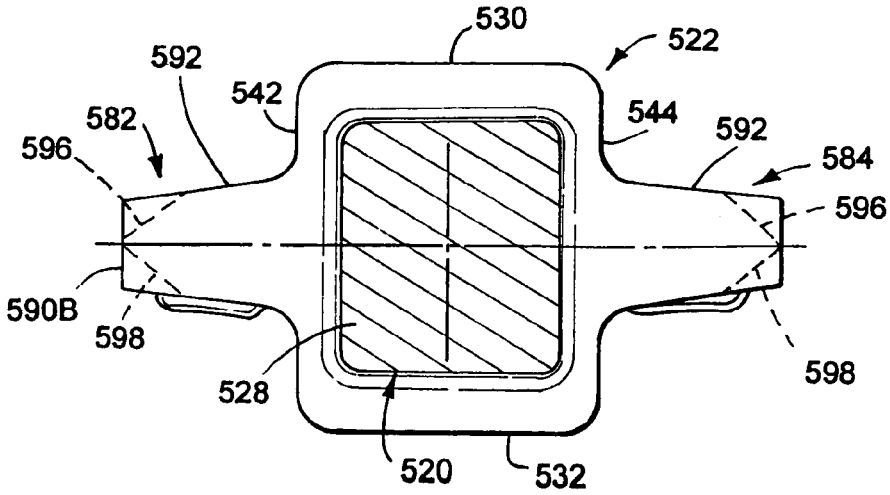
FIG. 25 is a sectional view taken along line 25—25 of FIG. 24.

FIGS. 24 and 25 illustrate another form of tooth forming part of a two-part digging tooth system. This alternative form of digging tooth is designated generally by reference numeral 522 in FIGS. 24 and 25. The elements of this alternative digging tooth that are functionally analogous to those components discussed above regarding digging tooth 22 are designated by reference numerals identical to those listed above regarding tooth 22 with the exception this embodiment uses reference numerals in the 500 series.

As shown in FIG. 24, the digging tooth 522 is configured for use with an adapter 520 with a nose portion 528 extending forward from an edge of an implement or bucket, as described above. The digging tooth 522 is operably connected to the adapter 520 through use of a conventional retaining apparatus 524. Digging tooth 522 has an elongated generally wedge shaped configuration including an upper surface 530 and a lower surface 532. The upper surface 530 slants from the rear end 534 and toward the forward end 536 of the tooth 522. The lower surface 532 is slants upward from the rear end 534 and toward the forward end 536 of the tooth 522. Preferably, the ends 534, 536 of the tooth are aligned along a central axis 538.

The ground engaging or digging tooth 522 further includes a pair of laterally spaced side surfaces 542 and 544. Digging tooth 522 further includes a cutting or ground penetrating edge 546 extending transversely across the forward end 536 thereof. To allow the tooth 522 to be mounted in operable combination with adapter 520, a blind cavity or socket 550 is defined by and opens to a rear end 534 of the tooth 522. As will be appreciated, the cavity 550, defined by and opening to the rear 534 of the tooth 522, has a cross-sectional configuration which compliments the cross-sectional configuration of the nose portion of adapter 520 whereby allowing adapter 520 and digging tooth 522 to be assembled in operable combination. That is, the cavity 550 defined by tooth 522 can have a generally rhombus-like cross-sectional configuration, a generally rectangular cross-sectional configuration, or any other suitable cross-sectional configuration without detracting or departing from the spirit and scope of the invention.

According to the present invention, and as shown in FIGS. 24 and 25, tooth 522 further includes wing structure 580 including first and second wing structures or lateral projections 582 and 584 extending laterally outwardly from the side surfaces 542 and 544, respectively, of the digging tooth 522. Preferably, the first and second wing structures or lateral projections 582 and 584 extend outward from and are proximately disposed midway between the upper and lower surfaces 530 and 532, respectively, of the tooth 522. In the same sense described above, the wing structure 580 including the projections 582, 584 serve to shield and protect ground engaging components disposed rearwardly of the rear end 536 of the digging tooth 522 against wear. Moreover, wing structure 580 serves to significantly widen the ground penetration zone provided by the digging tooth 522. Widening the penetration zone for the tooth also enhances ground penetration capability of the bucket edge while concomitantly reducing the energy required to effect such ends.

Each wing or projection 582, 584 is comprised of at least two longitudinally spaced sections. That is, wing 582 includes two laterally extending sections 582A and 582B disposed to the same side of the central axis relative to each other and preferably disposed in fore-and-aft and longitudinally spaced relation relative to each other. Similarly, wing 584 includes two laterally extending sections 584A and 584B preferably disposed in fore-and-aft and longitudinally spaced relation relative to each other. The fore-and-aft sections of each wing or lateral projection 582, 584 are preferably formed integral with the reminder of the digging tooth 522. In the embodiment illustrated in FIG. 24, the fore-and-aft longitudinally spaced sections of each wing 582, 584 are mirror images of each other. Accordingly, only the fore-and-aft longitudinally spaced projections or sections 582A and 582B comprising wing 582 will be discussed in detail.

Preferably, sections 582A and 582B of wing 582 extend laterally outward from the side surface 542 of tooth 522 proximately mid-distance between the upper and lower surfaces 530 and 532 of the digging tooth 522. In the illustrated embodiment, and while having sufficient strength to serve the purpose of which it is designed, each projection or wing section 582A and 582B comprising wing 582 has a relatively narrow vertical width, especially toward a forward end thereof, to promote ground penetration as the tooth is driven and moves horizontally through the ground.

In the illustrated embodiment, each rearwardly disposed wing section 582B of the wing structure 580 has a laterally widened portion 586B laterally extending from the side surface 542 of tooth a greater lateral width than does a laterally narrowed portion 586A of the forward disposed wing section 582A of the same wing structure. Each section 582A and 582B on wing 582 has a longitudinally extending outer edge portion 590A and 590B, respectively. Notably, however, the cumulative width and effect of the sections 582A and 582B is intended to be and is substantially equivalent to the lateral width of the comparable wing 182 on the above described digging tooth embodiment illustrated in FIGS. 8 through 12. Moreover, the cumulative width and effect of the wing sections 582A and 582B of wing 582 along with the cumulative width and effect of the wing sections 584A and 5 84B of wing 584 is intended to be and is substantially equivalent to the cumulative lateral width of the comparable wings 182 and 184 on the above described digging tooth embodiment illustrated in FIGS. 8 through 12.

As discussed regarding digging tooth 22, the outer edge portions 590A and 590B associated with each wing section 582A and 582B of a respective wing 582 can have different designs along the length thereof without detracting or departing from the spirit and scope of this invention. For example, in the embodiment shown in FIG. 24, the outer edge portion 590A of wing section 582A preferably extends a lesser lateral distance away from the central axis 538 of the digging tooth 522 than does the outer edge portion 590B of wing section 582B. In the embodiment illustrated in FIG. 24, the outer edge portion 590A of wing section 582A extends in generally parallel relation to the centerline axis 538 of the digging tooth 522 for a longitudinal distance ranging between about one-third and one-half the overall distance between ends 534 and 536 of the digging tooth 122. It will be appreciated, however, the outer edge portion 590B of wing section 582B could be configured with a swept back design without detracting or departing from the spirit and scope of the present invention.

In the exemplary embodiment shown in FIG. 24, the rear of the outer edge portion 590B of wing section 582B preferably extends in generally parallel relation to the centerline axis 538 of the digging tooth 522 for a longitudinal distance ranging between about one-third and one-half the overall distance between ends 534 and 536 of the digging tooth 522. In the preferred embodiment, the outer edge portion 590B thereafter laterally converges or angles toward the respective side surface of the tooth 522 from which wing section 583B laterally extends. Other designs or profiles can equally apply, however, to the rear wing section on opposed sides of the tooth 522 without departing or detracting from the spirit and scope of the present invention.

Turning to FIG. 25, the rearwardly disposed wing section of each wing 582, 584 extending outwardly from a respective side surface on the tooth 522, has a generally planar upper surface 592 extending toward the outer edge portion 590B. The upper surface 592 of the each wing extends in a direction extending generally parallel to the edge 546 at the forward end 536 of the digging tooth. Moreover, that lengthwise section of the outer edge portion 590B of wing section 582B linearly proximate to the rear of wing 582 is preferably configured to promote the entrapment of dirt fines between the wing edges of laterally adjacent teeth and the bucket edge.

In the embodiment shown in FIG. 24, the remaining edge portion of each rearwardly disposed wing section of the wings 582, 584 is preferably designed to promote ground penetration of the tooth 522. That is, the reminder of the extreme of each rearwardly disposed wing section of each wing structure 580 is preferably provided with first and second chamferred edges similar to the edges 596 and 598. Similarly, the outer edge portion 590A on each forward wing section of wing structure an likewise have angularly converging edges to provide the forward disposed sections of the wing structure 580 with a sharpened or knife-like configuration whereby promoting the ability of the wing structure 580 to slice, penetrate and fracture the ground ahead of the leading bucket edge.

In the embodiment illustrated in FIG. 24, and primarily because the rearwardly disposed wing sections 582B and 584B of wings or projections 582 and 584, respectively, extend laterally outwardly from an area on the sides surfaces 542, 544. Preferably, the wing sections 582B and 584B of wings or projections 582 and 584, respectively, are arranged proximately midway between the upper and lower surfaces 530, 532 of the digging tooth. Moreover, in the illustrated embodiment, the rearwardly disposed wing sections 582B and 584B on the digging tooth 522 furthermore each preferably define a pair of open top, channels 583 and 585 substantially similar to those channels 183 and 185 discussed above. Accordingly, no further details need be provided for a proper and complete understanding thereof Moreover, the digging tooth 522 can be configured to effect compression of a flex-pin type retaining apparatus used to releasably secure the adapter 520 and digging tooth 522 together as discussed in detail above. The structure for effecting compression of a flex-pin type retaining apparatus can be substantially similar to the structure discussed above with respect to tooth 122 and, thus, no further details need be provided for both a full and complete understanding thereof Additionally, the digging tooth 522 can be configured to inhibit inadvertent lateral shifting of the retaining apparatus. The structure for inhibiting inadvertent lateral shifting of the retaining apparatus can be substantially similar to the structure discussed above with respect to tooth 122 and, thus, no further details need be provided for both a full and complete understanding thereof.

Figure 26:
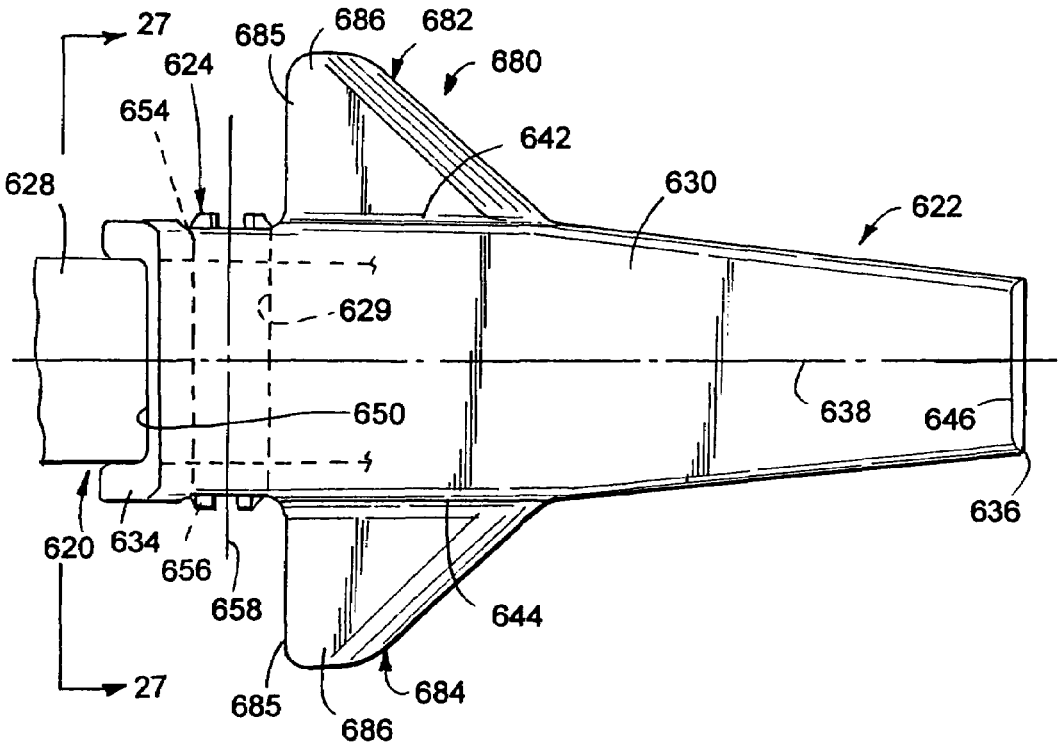
FIG. 26 is a top plan view of another embodiment of the present invention.
Figure 27:
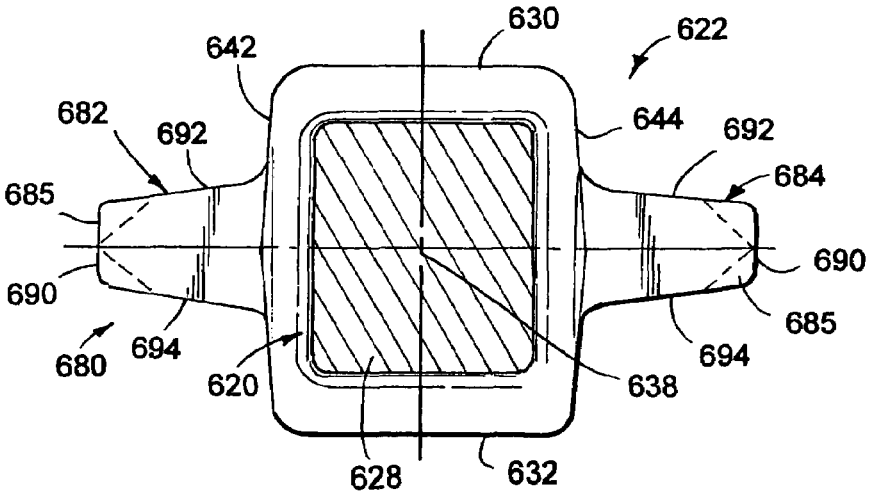
FIG. 27 is a sectional view taken along line 27—27 of FIG. 26.

FIGS. 26 and 27 illustrate another form of tooth forming part of a two-part digging tooth system. This alternative form of digging tooth is designated generally by reference numeral 622 in FIGS. 26 and 27. The elements of this alternative digging tooth that are functionally analogous to those components discussed above regarding digging tooth 22 are designated by reference numerals identical to those listed above regarding tooth 22 with the exception this embodiment uses reference numerals in the 600 series.

As shown in FIG. 26, the digging tooth 622 is configured for use with an adapter 620 with a nose portion 628 extending forward from an edge of an implement or bucket, as described above. The digging tooth 622 is operably connected to the adapter 520 through use of a conventional retaining apparatus 624 which passes through bores 654, 656 in the tooth 622 and through a bore 629 in the adapter 620. Notably, the bores 654, 656 in the tooth 622 define an axis 658. Digging tooth 622 has an elongated generally wedge shaped configuration including an upper surface 630 and a lower surface 632. The upper surface 630 slants from the rear end 634 and toward the forward end 636 of the tooth 622. The lower surface 632 is slants upward from the rear end 634 and toward the forward end 636 of the tooth 622. Preferably, the ends 634, 636 of the tooth are aligned along a central axis 638.

The ground engaging or digging tooth 622 further includes a pair of laterally spaced side surfaces 642 and 644. Digging tooth 622 further includes a cutting or ground penetrating edge 646 extending transversely across the forward end 636 thereof. To allow the tooth 622 to be mounted in operable combination with adapter 620, a blind cavity or socket 650 is defined by and opens to a rear end 634 of the tooth 622. As will be appreciated, the cavity 650, defined by and opening to the rear 634 of the tooth 622, has a cross-sectional configuration which compliments the cross-sectional configuration of the nose portion of adapter 620 whereby allowing adapter 620 and digging tooth 622 to be assembled in operable combination. That is, the cavity 650 defined by tooth 622 can have a generally rhombus-like cross-sectional configuration, a generally rectangular cross-sectional configuration, or any other suitable cross-sectional configuration without detracting or departing from the spirit and scope of the invention.

According to the present invention, and as shown in FIGS. 26 and 27, tooth 622 further includes wing structure 680 including first and second wing structures or lateral projections 682 and 684 extending laterally outwardly from the side surfaces 642 and 644, respectively, of and formed integral with the digging tooth 622. In the same manner described above, the wing structures or lateral projections 682 and 684, respectively, comprising the wing structure 680 have a laterally widened rear portion 686 serving to shield and protect ground engaging components disposed rearwardly of the rear of the digging tooth 622. Widening the penetration zone for the digging tooth also enhances ground penetration capability of the bucket edge while concomitantly reducing the energy required to effect such ends.

The wing or projection 682 has upper and lower generally planar and horizontally disposed surfaces 692 and 694, respectively, extending from the side surface 642 of the digging tooth 622 and toward the outer edge 690. Similarly, the wing or projection 684 has upper and lower generally planar and horizontally disposed surfaces 692 and 694, respectively, extending from the side surface 644 of the digging tooth 622 and toward the outer edge 690. The outer edge 690 extends forward from the laterally widened portion 686 on each projection 682, 684 and converges toward the central axis 638 of the digging tooth whereby providing the digging tooth with a progressively widening ground penetration zone for facilitating ground penetration of the bucket edge. Moreover, a major longitudinal length of the outer edge 690 provided on each extension or projection 682, 684 is preferably chamferred to enhance digging tooth penetration as it is forcibly driven through the ground.

As shown, each projection 682, 684 has a rear edge 685. To promote the insertion of the retaining apparatus 624 into operable association with the adapter 620 and digging tooth 622, the rear edge 685 of each lateral projection 682, 684 is disposed forward of the axis 658 defined by the bore 654, 656 in the digging tooth 622.

Figure 28:
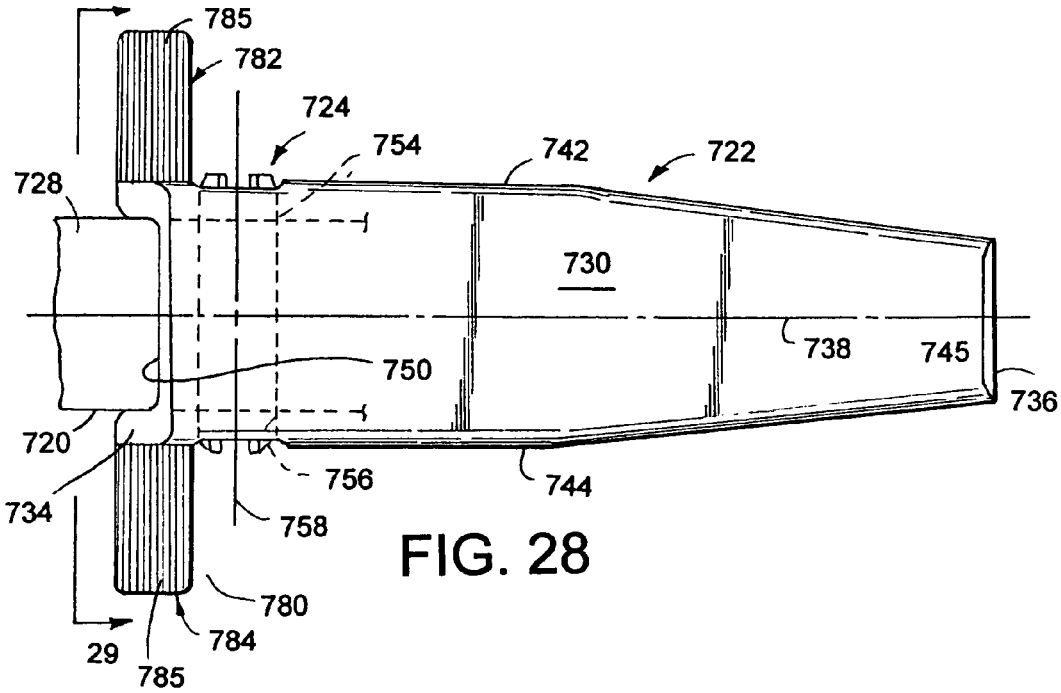
FIG. 28 is a top plan view of another embodiment of the present invention.
Figure 29:
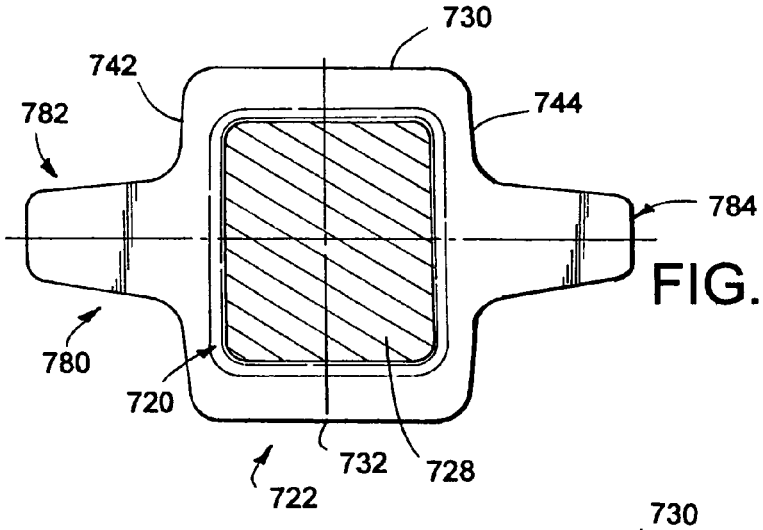
FIG. 29 is a sectional view taken along line 29—29 of FIG. 28.
Figure 30:
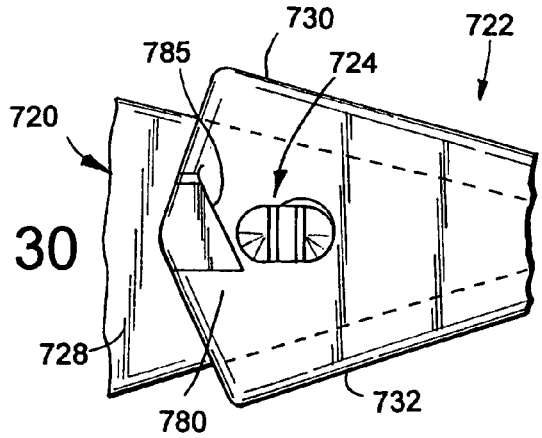
FIG. 30 is a fragmentary side elavational view of that embodiment of then invention illustrated in FIG. 28.

FIGS. 28, 29 and 30 illustrate still another form of tooth forming part of a two-part digging tooth system. This alternative form of digging tooth is designated generally by reference numeral 722 in FIGS. 28 through 30. The elements of this alternative digging tooth that are functionally analogous to those components discussed above regarding digging tooth 22 are designated by reference numerals identical to those listed above regarding tooth 22 with the exception this embodiment uses reference numerals in the 700 series.

As shown in FIGS. 28 and 30, digging tooth 722 is configured for use with an adapter 720 having a nose portion 728 extending forward from an edge of an implement or bucket, as described above. The digging tooth 722 is operably connected to the adapter 720 through use of a conventional retaining apparatus 724 which passes through bores 754, 756 in the tooth 722 and through a bore 729 in the adapter 720. Notably, the bores 754, 756 in the tooth 722 define an axis 758. Digging tooth 722 has an elongated generally wedge shaped configuration including an upper surface 730 and a lower surface 732. The upper surface 730 slants from the rear end 734 and toward the forward end 736 of the tooth 722. The lower surface 732 slants upward from the rear end 734 and toward the forward end 736 of the tooth 722. Preferably, the ends 734, 736 of the tooth are aligned along a central axis 738.

The ground engaging or digging tooth 722 further includes a pair of laterally spaced side surfaces 742 and 744. Digging tooth 722 further includes a cutting or ground penetrating edge 746 extending transversely across the forward end 736 thereof. To allow the tooth 722 to be mounted in operable combination with adapter 720, a blind cavity or socket 750 is defined by and opens to a rear end 734 of the tooth 722. As will be appreciated, the cavity 750, defined by and opening to the rear 734 of the tooth 722, has a cross-sectional configuration which compliments the cross-sectional configuration of the nose portion of adapter 720 whereby allowing adapter 720 and digging tooth 722 to be assembled in operable combination. That is, the cavity 750 defined by tooth 722 can have a generally rhombus-like cross-sectional configuration, a generally rectangular cross-sectional configuration, or any other suitable cross-sectional configuration without detracting or departing from the spirit and scope of the invention.

According to the present invention, and as shown in FIGS. 28 through 30, tooth 722 further includes wing structure 780 including first and second wing structures or lateral projections 782 and 784 extending laterally outwardly from the side surfaces 742 and 744, respectively, of and formed integral with the digging tooth 722. In the same manner described above, the wing structures or lateral projections 782 and 784, respectively, comprising the wing structure 680 widening the penetration zone for the digging tooth, enhance ground penetration capability of the bucket edge while concomitantly protecting the cutting edge of the implement against wear.

As shown, each projection 782, 784 extends forward from the rear 734 of the digging tooth and has a front or forward edge 785. To promote the insertion of the retaining apparatus 724 into operable association with the adapter 720 and digging tooth 722, the forward edge 785 of each lateral projection 782, 784 is disposed rearward of the axis 758 defined by the bore 754, 756 in the digging tooth 722.

Figure 31:
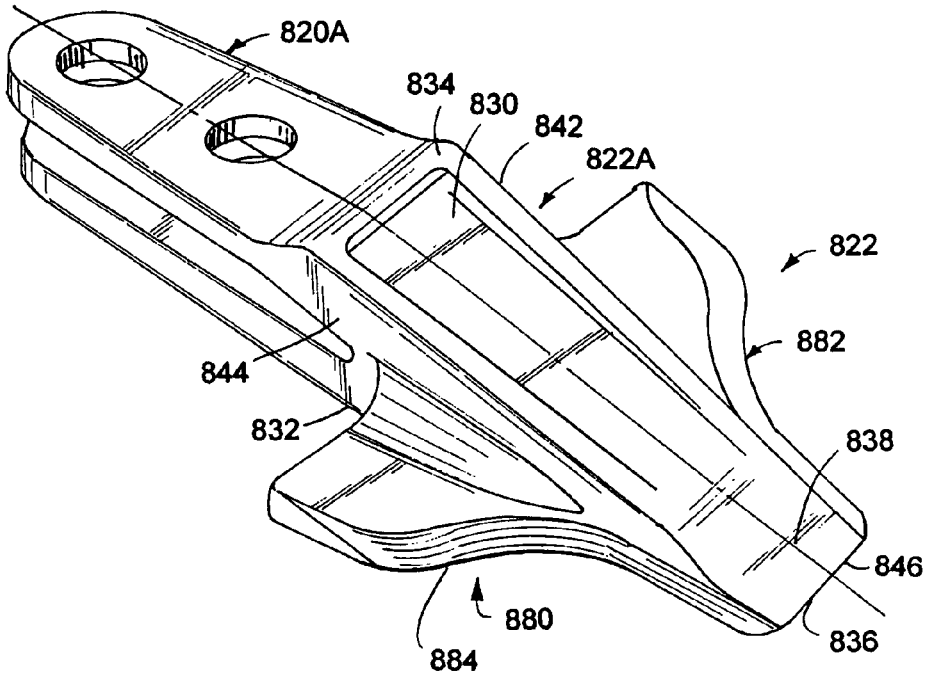
FIG. 31 is a perspective view of another form of present invention.
Figure 32:
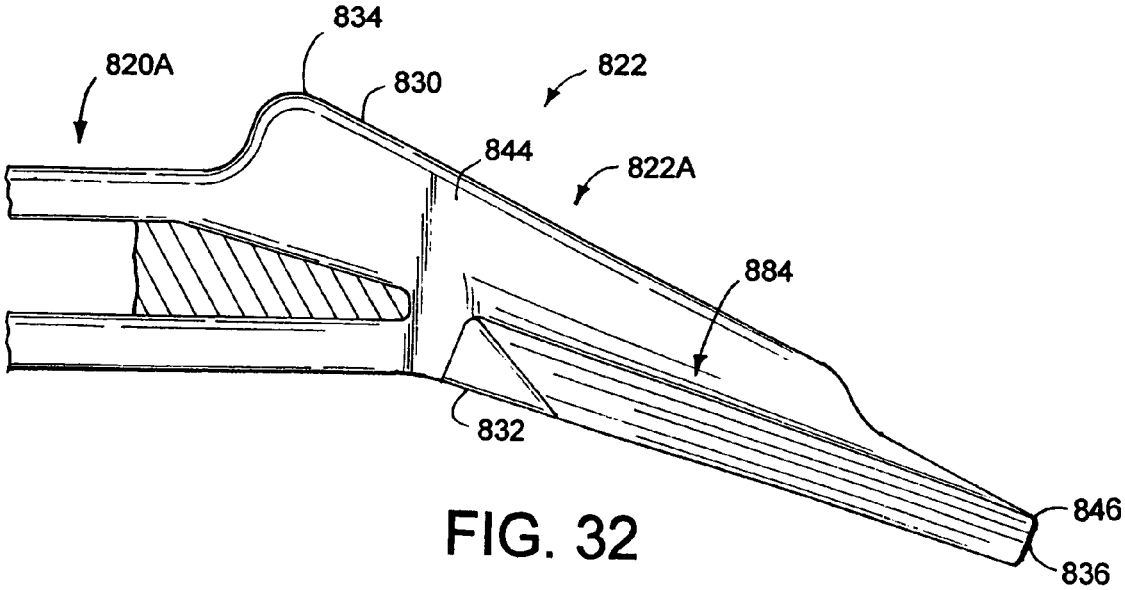
FIG. 32 is a side elevational view of that embodiment of the invention illustrated in FIG. 31.

As will be appreciated, and without detracting or departing from the spirit and scope of the scope of the present invention, the principals of the present invention equally apply to digging teeth of a unitary or one-piece design. FIGS. 31 and 32 illustrate a one-piece or unitary digging tooth. This alternative form of digging tooth is designated generally by reference numeral 822 in FIGS. 31 and 32. The elements of this alternative digging tooth that are functionally analogous to those components discussed above regarding digging tooth 22 are designated by reference numerals identical to those listed above regarding tooth 22 with the exception this embodiment uses reference numerals in the 800 series.

As shown, digging tooth 822 includes an adapter portion 820A and a digging tooth portion 822A formed as a single piece. The adapter portion 820A of digging tooth 822 is configured to allow for attachment of the digging tooth 822 to the leading edge of the bucket or lip just as adapter 20 was attached to the bucket or lip.

The digging tooth portion 822A of digging tooth 822 has an elongated generally wedge shaped configuration including an upper surface 830 and a lower surface 832. The upper surface 830 slants from the rear end 834 of the digging tooth portion 822A and toward the forward end 836 of the tooth portion 822A. The lower surface 832 slants upward from the rear end 834 and toward the forward end 836 of the tooth 822. In the illustrated embodiment, the ends 834, 836 as well as adapter portion 820A are all aligned along a central axis 838. The digging tooth portion 822A of the ground engaging or digging tooth 822 further includes a pair of laterally spaced side surfaces 842 and 844. Digging tooth 822 further includes a cutting or ground penetrating edge 846 extending transversely across the forward end 836 thereof.

According to the present invention, and as shown in FIGS. 31 and 32, tooth 822 further includes wing structure 880 including first and second wing structures or lateral projections 882 and 884 extending laterally outwardly from the side surfaces 842 and 844, respectively, of and preferably formed integral with the digging tooth portion 820A. In the same manner described above, the wing structures or lateral projections 882 and 884, respectively, comprising the wing structure 880 widen the penetration zone for the digging tooth, enhance ground penetration capability of the bucket edge while concomitantly protecting the cutting edge of the implement against wear.

After teeth embodying principals of the present invention are operably coupled to the digging implement or bucket, a lateral spacing of about 0.5 inches to about 0.75 inches is preferably provided between the outer edges of adjacent wings on laterally adjacent digging teeth. Largely depending upon their size, and after the winged teeth are operably coupled to the digging implement or bucket, a fore-and-aft spacing of about 0.5 inch to about 4.0 inches is preferably provided between the rear end of the winged structure on the digging teeth and the forward/leading edge 14 of the bucket. Such spacings allow for inadvertent misalignment of the adapters relative to the bucket edge. Such spacing also facilitates entrapment of dirt fines between adjacent digging teeth and the leading bucket edge. Of course, and without detracting from the spirit and scope of the invention, the wing structure on each tooth can extend rearwardly beyond the rear end of the respective digging tooth and toward the leading edge of the bucket lip.

With the present invention, each time a digging tooth is replaced, new edge protection is afforded to the bucket lip whereby extending its useful life. The wing structure on the digging tooth is designed and disposed as to shield those ground engaging components disposed rearwardly of the rear edge of the digging or ground engaging tooth from wear and to promote ground penetration for the bucket. Due to the enhanced ground penetrating capabilities offered by the winged teeth, a non-beveled blade edge will readily suffice for the bucket, resulting in a more economic and stronger base edge for the bucket.

With the present invention, almost the entire leading edge of the bucket lip is protected against wear by the wing structure on the digging teeth penetrating, fracturing and slicing the ground in advance of the bucket edge passing therethrough. Since the wing structure on the digging tooth of the present invention serve to penetrate and fracture the ground in advance of the bucket edge moving therethrough, the savings associated with either prolonging the purchase of a new cutting edge or the potential elimination of the need for costly carbide hardfacing of the bucket edge can be realized. Moreover, and in the embodiment wherein the wing structure on the digging tooth is arranged generally symmetrically about the digging tooth central axis, such design allows the teeth to be reversed or rotated about the centerline to maximize their utility.

Those tooth embodiments defining an open channel on one of the generally planar surfaces of the wing structure provide numerous advantages especially when a flex-pin style retaining apparatus is used to couple the adapter and digging tooth in combination with each other. As discussed above in detail, the digging tooth design having open channels facilitates flex-pin insertion by effecting compression of the flex-pin width in the range of approximately 15% to 40%. Compression of the width of the flex-pin by 15% to 40% will be specially advantageous in those commonly known situations where the holes on the digging tooth fail to align in a fore-and-aft direction with the opening or bore in the adapter receiving the flex-pin. Moreover, the open channel on at least one of the upper or lower generally planar surfaces of the digging tooth wing serves a dual purpose. First, the channel serves as a pin holder in a relatively space constrained location. Second, the sides of the open channel serve as tool guides during installation of the retaining apparatus.

Those skilled in the art recognize the retaining pins for such retaining apparatus come in multiple lengths. Operators using longer retaining pins on conventional digging teeth face the definite prospect that the ends of the retaining pin will protrude from opposed sides of the digging tooth and, thus, the pin can become dislodged by the digging forces to which the pin ends are exposed. Of course, should the retainer become inadvertently or otherwise dislodged, separation and loss of the digging tooth from the two-part system is likely to result. With a preferred form of the invention, and following retainer installation, the sides of the open channels wrap about and extend at least partially along lengthwise end portions of the retainer extending from opposed sides of the tooth whereby protecting the free ends of the retaining apparatus. Moreover, and with another preferred form of the invention, the tooth is configured to provide an additional locking feature to inhibit inadvertent linear shifting of the retainer apparatus relative to the tooth and adapter thereby guarding against inadvertent separation and loss of the digging tooth during a digging operation.

From the foregoing, it will be observed that numerous modifications and variations can be made and effected without departing or detracting from the true spirit and novel concept of the present invention. Moreover, it will be appreciated, the present disclosure is intended to set forth an exemplification of the invention which is not intended to limit the invention to the specific embodiment illustrated. Rather, this disclosure is intended to cover by the appended claims all such modifications and variations as fall within the spirit and scope of the claims.

What is claimed is:

1. A digging tooth adapted to extend forward from a digging implement having a transversely extending edge, said digging tooth defining a longitudinal centerline and has a forward end portion, with a cutting edge extending thereacross and a rear end portion configured for attachment to the edge of said implement, said digging tooth further including upper and lower angularly diverging surfaces having opposed side surfaces therebetween, and with said digging tooth further including a wing projecting laterally outwardly from each side surface on said tooth, with each wing having upper and lower planar surfaces each extending in a direction generally paralleling the cutting edge extending across the forward end portion of the digging tooth and with the upper surface of each wing being disposed in other than a planar relationship relative to the upper surface of the digging tooth, and wherein each wing has a laterally widened rear portion, a laterally narrowed forward portion, and an outer edge extending therebetween for providing said tooth with a progressively widening ground fracturing zone whereby yielding significant wear protection for the edge of the implement.

2. The digging tooth according to claim 1 wherein each wing has first and second surfaces which, toward the outer edge thereof, converge relative to each other to provide a cutting edge for each wing.

3. The digging tooth according to claim 1 wherein the rear end portion thereof is configured with a blind cavity for receiving and accommodating a lengthwise section of a nose section of an adapter extending from the transversely extending edge on the digging implement.

4. The digging tooth according to claim 3 wherein the laterally widened rear portion of each wing extends outward and forward from the rear end portion of said tooth.

5. The digging tooth according to claim 3 wherein the blind cavity opens to a rear of said tooth and has a cross-sectional profile having a generally rhombus-like configuration for a major lengthwise portion thereof.

6. The digging tooth according to claim 3 further defining a bore defining an axis, with said bore opening to said blind cavity defined by said tooth for accommodating at least a portion of a retaining apparatus used to releasably secure said tooth and said adapter in operable combination.

7. The digging tooth according to claim 6 wherein each wing on the digging tooth defines a channel opening to one of said upper and lower planar surfaces on each wing and arranged in general alignment relative to each other and relative to the axis of said bore for accommodating and aligning said retaining apparatus relative to the axis defined by said bore.

8. The digging tooth according to claim 7 wherein each wing projects laterally outward from an area on a respective side surface of the digging tooth arranged proximately midway between the upper and lower surfaces on the digging tooth such that the upper generally planar surface on each wing on the tooth is disposed and configured to protect ends of said retaining apparatus extending beyond opposed side surfaces of the digging tooth.

9. The digging tooth according to claim 6 wherein the retaining apparatus for releasably securing the adapter and tooth in operable combination relative to each other includes an elongated flex-pin retainer, and wherein an area of said digging tooth arranged in proximate relation relative to said bore is configured to impart radial compression to an end of said flex-pin as said flex-pin is inserted into position to maintain said tooth and adapter in operable combination.

10. The digging tooth according to claim 6 wherein an area of said digging tooth arranged in proximate relation relative to said bore is configured to inhibit inadvertent axial shifting of said retaining apparatus relative to said adapter or tooth.

11. The digging tooth according to claim 1 wherein the wing projecting laterally outward from each side surface of said tooth is integrally formed as part of and with the remainder of said tooth.

12. The digging tooth according to claim 1 wherein the upper and lower surfaces of each wing are disposed in other than a planar relationship relative to both the upper and lower surfaces of said digging tooth.

13. An elongated digging tooth adapted to extend forwardly from a digging implement having a transversely extending edge, said digging tooth defining a central axis and has a forward end portion, with a transverse cutting edge, and a rear end portion configured for attachment to the transversely extending edge of said implement, said digging tooth further including upper and lower angularly diverging surfaces having opposed side surfaces therebetween, and wherein said digging tooth further includes wing structure projecting generally horizontally and laterally outward from an area on one side of said tooth, with said wing structure having generally horizontal upper and lower surfaces, and with the upper surface of said wing structure being disposed in other than a planar relationship relative to the upper surface of the digging tooth, with said wing structure having a rear laterally widened portion, a laterally narrowed front portion, and an outer edge extending therebetween and converging toward the central axis of said tooth whereby providing said digging tooth with a widening ground penetration zone for facilitating penetration of the transversely extending edge on the digging implement.

14. The elongated digging tooth according to claim 13 wherein a major lengthwise section of the outer edge on said wing structure is configured with a cutting edge for promoting ground penetration of the digging tooth.

15. The elongated digging tooth according to claim 13 wherein said wing structure is arranged on said tooth in generally symmetrical relation relative to said central axis whereby permitting said tooth to be reversed about said central axis.

16. The elongated digging tooth according to claim 13 wherein a second wing structure is provided on and projects generally horizontally and laterally outward from an area on an opposite side of said tooth, with said second wing structure having generally horizontal upper and lower surfaces, and with the upper surface of said second wing structure being disposed in other than a planar relationship relative to the upper surface of the digging tooth, with said second wing structure having a rear laterally widened portion, a laterally narrowed front portion, and an outer edge extending therebetween and converging toward the central axis of said tooth whereby providing said digging tooth with a widening ground penetration zone for facilitating penetration of the transversely extending edge on the digging implement.

17. The elongated digging tooth according to claim 13 wherein said second wing structure extends from an area on one side of said tooth proximately midway between the upper and lower surfaces of said tooth.

18. The elongated digging tooth according to claim 13 wherein the rear end portion of the digging tooth is configured with a blind cavity for receiving and accommodating a lengthwise section of a nose section of an adapter extending from the transversely extending edge of the digging implement.

19. The elongated digging tooth according to claim 18 wherein the rear widened portion of said second wing structure extends outward and forward from the rear end portion of said tooth.

20. The elongated digging tooth according to claim 18 further including a bore opening to said blind cavity defined by said tooth for accommodating at least a lengthwise portion of a retaining apparatus used to releasably securing said tooth and said adapter in operable combination relative to each other.

21. The elongated digging tooth according to claim 18 further including opposed surfaces arranged within said blind cavity defined by said tooth for adding stability to said tooth after said tooth is arranged in operable combination with said adapter.

22. The elongated digging tooth according to claim 18 wherein a marginal edge extending about said blind cavity provided at the rearward end portion of the tooth has a generally rhombus-like cross-sectional configuration.

23. The elongated digging tooth according to claim 18 further including pair of axially aligned bores which each open to the blind cavity defined by said tooth and are disposed along an axis extending at an angle ranging between about 25° and about 65° relative to the transverse cutting edge at the forward end portion of said tooth.

24. The digging tooth according to claim 13 wherein the wing structure projecting generally horizontally and laterally from said one side of said tooth is integrally formed as part of and with the remainder of said tooth.

25. The digging tooth according to claim 13 wherein the generally horizontal upper and lower surfaces of said wing structure are disposed in other than a planar relationship relative to both the upper and lower surfaces of said digging tooth.

26. In combination with a bucket having a forward edge with a plurality of two-part digging tooth assemblies connected to said edge in side-by-side relation relative to each other, with each digging tooth assembly including an adapter secured to said bucket at said edge, said adapter having a nose portion extending forward from said edge and to which a replaceable digging tooth is releasably secured, with each digging tooth having a forward end, with an edge transversely extending thereacross, a rear end, arranged adjacent to the bucket edge and defining a blind cavity for receiving the nose portion of said adapter, with said forward and rearward ends of said tooth being aligned relative to a central axis of the tooth, an upper surface extending forward and downwardly from the rearward end and toward the forward end of said digging tooth, and a lower surface extending forward and upwardly from the rearward end and toward the forward end of said digging tooth, and with each digging tooth further including a pair of wings extending outward and generally parallel to the forward edge on said tooth from an area on each side of the tooth proximate midway between the upper and lower surfaces of said tooth, with each wing on said tooth having a rear laterally widened portion and a laterally narrowed front portion such that, for a major length thereof, an outer edge of each wing converges toward the central axis of said tooth from which said wing extends and diverges relative to the outer edge of a wing on an adjacent tooth, and wherein the wings on each tooth are configured to protect that portion of said bucket edge disposed between adjacent tooth assemblies against wear.

27. The invention according to claim 26 wherein rearward ends of the outer edges of the wings on laterally adjacent digging tooth assemblies are laterally spaced by a distance ranging between about 0.5 inches and about 1.25 inches.

28. The invention according to claim 26 wherein the wings on each digging tooth are integrally formed as part of and with the remainder of each tooth.

29. The invention according to claim 26 wherein the digging tooth defines a bore opening to said cavity defined by said tooth for accommodating at least a portion of a retaining apparatus used to releasably secure said tooth and said adapter of each digging tooth assembly in operable combination relative to each other.

30. The invention according to claim 29 wherein the wing on each digging tooth has first and second generally planar surfaces, and with the outer edge of the wing on each digging tooth being configured to provide each wing with a cutting edge for facilitating ground penetration.

31. The invention according to claim 30 wherein one of said first and second generally planar surfaces of each wing on said tooth further defines an open channel arranged in general alignment with the axis of said bore defined by said tooth for accommodating and aligning said retaining apparatus with said bore defined by said tooth.

32. The invention according to claim 30 wherein an area of said digging tooth arranged in proximate relation relative to the bore defined by said tooth is configured to impart a compressive force to said retaining apparatus as said retaining apparatus is inserted into a position to maintain said tooth and adapter in operable combination relative to each other.

33. The invention according to claim 30 wherein an area of said digging tooth arranged in proximate relation relative to the bore defined by said tooth is configured to inhibit inadvertent axial shifting of said retaining apparatus relative to said adapter or tooth.

34. The invention according to claim 31 wherein the generally planar surface of each wing on said tooth defining said open channel is configured to protect a lengthwise potion of said retaining apparatus extending beyond either side of said digging tooth.

35. The invention according to claim 26 wherein each digging tooth further includes opposed surfaces arranged within said cavity for adding stability to said tooth after said tooth is arranged in operable combination with the respective adapter of said digging tooth assembly.

36. The invention according to claim 26 wherein the tooth of each of said digging tooth assemblies is configured such that said cavity defined therein has a generally rhombus-like cross-sectional configuration.

37. The invention according to claim 26 wherein the tooth of each of said digging tooth assemblies defines a pair of axially aligned bores opening to the cavity of said tooth and are disposed along an axis extending at an angle ranging between about 25° and about 65° relative to the transversely extending edge at the forward end of said tooth.

38. The invention according to claim 26 wherein the rear laterally widened portion on each wing of the digging tooth extends laterally and forward from the rear end of the digging tooth.

39. A ground engaging tooth adapted to be mounted to a digging implement having a wear component arranged rearwardly of said digging tooth after said digging tooth is mounted on said digging implement, said ground engaging tooth defining a central axis and has a forward end portion, with a cutting edge extending transversely thereacross, a rear end portion, upper and lower angularly diverging surfaces having opposed side surfaces therebetween, and wherein said tooth is further provided with a free ended wing extending away from and longitudinally along at least one surface of said tooth between the rear end portion and forward end portion thereof, with a rear portion of said wing extending away from said at least one surface of said tooth a greater distance than does a forward portion thereof such that an outer edge of said wing, between the forward an rearward portions thereof, converges toward the central axis and such that, following initial ground penetration, the outer edge of the wing is disposed to initially fracture the ground through which said tooth passes whereby reducing wear on the wear component arranged rearwardly of the digging tooth.

40. The ground engaging tooth according to claim 39 wherein said wing extends away from the upper surface of said tooth and generally normal to the cutting edge extending transversely across the forward end of said tooth.

41. The ground engaging tooth according to claim 39 wherein said wing is laterally offset relative to the upper surface of said tooth such that said wing is disposed closer to one side surface of said tooth than the other.

42. The ground engaging tooth according to claim 39 wherein said wing extends vertically from and longitudinally along an area on said upper surface generally centralized between the side surfaces on said tooth.

43. The ground engaging tooth according to claim 39 wherein said wing has first and second surfaces which, toward the outer edge thereof, converge relative to each other to provide a cutting edge for said wing.

44. The ground engaging tooth according to claim 39 wherein the rear end portion of said tooth defines a blind cavity opening to a rear of said tooth for receiving and accommodating a lengthwise section of a nose portion of an adapter extending from a transversely extending edge on the digging implement.

45. The ground engaging tooth according to claim 44 wherein the blind cavity opening to the rear of said tooth has a cross-sectional profile having a generally rhombus-like cross-sectional configuration for a major lengthwise portion thereof.

46. The ground engaging tooth according to claim 44 wherein the blind cavity at the rear end portion of said tooth has a cross-sectional profile with a generally rectangular configuration for a major lengthwise portion thereof.

47. The ground engaging tooth according to claim 44 wherein said wing has upper and lower generally parallel surfaces extending laterally outward from one side surface on said tooth, with the upper and lower surfaces of said wing being disposed between and in other than planar relationship relative to the upper and lower surfaces of said tooth.

48. The ground engaging tooth according to claim 47 wherein the laterally widened rear portion of said wing extends outward and forward from the rear of said tooth.

49. The ground engaging tooth according to claim 44 wherein said wing laterally extends outwardly from one side surface on said tooth proximately midway between said upper and lower surfaces and in a direction generally parallel to the cutting edge extending transversely across the forward end portion of said tooth.

50. The ground engaging tooth according to claim 49 wherein said wing is disposed generally symmetrical relative to said central axis whereby permitting said tooth to be reversed about said central axis.

51. The ground engaging tooth according to claim 47 further including a second free ended wing configured as a mirror image of the other free ended wing and having upper and lower generally planar surfaces, with said second free ended wing extending laterally outward from the other side surface on said tooth.

52. The ground engaging tooth according to claim 51 wherein said second wing extends laterally outward from the other side surface of said tooth proximately midway between said upper and lower surfaces and in a direction generally parallel to the cutting edge extending transversely across the forward end of said tooth.

53. The ground engaging tooth according to claim 51 wherein a rearward portion of each wing laterally extending from a respective side surface of the tooth has an upper generally planar and generally horizontal surface.

54. The ground engaging tooth according to claim 53 wherein said tooth further defines a bore having an axis extending generally normal to the central axis of said tooth, with said bore opening to said blind cavity defined by said tooth for accommodating at least a lengthwise portion of a retaining apparatus used to releasably secure said tooth and said adapter in operable combination relative to each other.

55. The ground engaging tooth according to claim 54 wherein the upper generally planar surface of each wing on said tooth further defines an open top channel arranged in general alignment with the axis of said throughbore for accommodating and aligning said retaining apparatus with said throughbore.

56. The ground engaging tooth according to claim 54 wherein said retaining apparatus used to releasably secure said tooth and said adapter in operable combination relative to each other includes an elongated flex-pin, and wherein an area of said tooth arranged in proximate relation relative to said bore defined by said tooth is configured to compress said flex-pin as said flex-pin is inserted into a position to maintain said tooth and adapter in operable combination relative to each other.

57. The ground engaging tooth according to claim 54 wherein an area of said tooth arranged in proximate relation relative to said bore defined by said tooth is configured to inhibit inadvertent axial shifting of said retaining apparatus relative to said adapter or tooth.

58. The ground engaging tooth according to claim 54 wherein the upper generally planar surface of each wing on said tooth is configured to protect a lengthwise portion of said retaining apparatus extending beyond opposed sides of said tooth.

59. The ground engaging tooth according to claim 39 wherein the free ended wing extending away from and along said at least one surface of said tooth is integrally formed as part of and with the remainder of said tooth.

60. A ground engaging tooth adapted to be mounted to a digging implement having a wear component arranged rearwardly of said digging tooth after said digging tooth is mounted on said digging implement, said ground engaging tooth defining a central axis and has a forward end portion, with a cutting edge extending transversely thereacross, a rear end portion, upper and lower angularly diverging surfaces having opposed side surfaces therebetween, and wherein said tooth is further provided with a first wing extending away from and longitudinally along at least a lengthwise portion of at one surface on said tooth, with the lengthwise portion of said wing having a length less than a length between the forward and rearward end portions of said tooth, and a second wing extending from said at least one surface on said tooth rearward of and in general longitudinal alignment with said first wing, with each of said first and second wings having an outer edge, and with said first and second wings being configured to combine with each other to fracture the ground through which said tooth passes whereby reducing wear on the wear component arranged rearwardly of the digging tooth.

61. The ground engaging tooth according to claim 60 wherein the rear end portion of said digging tooth defines a blind cavity opening to a rear of said tooth for receiving and accommodating a lengthwise section of a nose portion of an adapter extending forwardly from a leading edge of the digging implement.

62. The ground engaging tooth according to claim 61 wherein the blind cavity opening to the rear of said tooth has a cross-sectional profile having a generally rhombus-like cross-sectional configuration for a major lengthwise portion thereof.

63. The ground engaging tooth according to claim 61 wherein the blind cavity at the rear end portion of said tooth has a cross-sectional profile with a generally rectangular configuration for a major lengthwise portion thereof.

64. The ground engaging tooth according to claim 60 further including third and fourth wings extending from another surface on said tooth disposed in opposed relation relative to said at least one surface, with said third and fourth wings being configured as a mirror image of the said first and second wings, respectively.

65. An elongated digging tooth for a two-piece digging tooth assembly adapted to be secured to a transversely extending edge of a bucket, said digging tooth defining a central axis and having a front end, with a cutting edge transversely extending thereacross, a rear end having a blind cavity opening thereto for receiving and accommodating a nose portion of an adapter extending forward from the transversely extending edge of the bucket, with said tooth and said adapter each defining a bore which are arranged in registry with one another after said digging tooth and adapter are conjoined so as to allow a retaining apparatus to pass at least partially through said bores whereby maintaining said tooth and adapter in operable combination with each other, and wherein the bore defined by said tooth defines an axis extending generally normal to the central axis of said tooth, with said digging tooth further including an upper surface extending forward and downwardly from the rearward end and toward the cutting edge of said digging tooth, and a lower surface extending forward and upwardly from the rearward end and toward the cutting edge of said digging tooth, and with said digging tooth further including a generally horizontal wing extending laterally outward from an area on one side of said tooth, with said wing having generally parallel and horizontal upper and lower surfaces, with said wing having a laterally widened rear portion, disposed forward of the axis defined by the bore in said tooth and an outer edge extending forward from the laterally widened rear portion of the wing and converging toward the central axis of said tooth whereby providing said digging tooth with a progressively widening ground penetration zone for facilitating penetration of said bucket edge.

66. The elongated digging tooth according to claim 65 wherein said wing is integrally formed as part of and with the remainder of said tooth.

67. The elongated digging tooth according to claim 65 wherein said tooth is configured such that a marginal edge extending about said cavity opening to the rear end of the tooth has a generally rectangular-like cross-sectional configuration.

68. The elongated digging tooth according to claim 65 wherein said wing is arranged on said tooth in generally symmetrical relation relative to said central axis whereby permitting said tooth to be reversed about said central axis.

69. An elongated digging tooth for a two-piece digging tooth assembly adapted to be secured to a transversely extending edge of a bucket, said digging tooth defining a central axis and having a front end, with a cutting edge transversely extending thereacross, a rear end having a blind cavity opening thereto for receiving and accommodating a nose portion of an adapter extending forward from the transversely extending edge of the bucket, with said tooth and said adapter each defining a bore which are arranged in registry with one another after said digging tooth and adapter are conjoined so as to allow a retaining apparatus to pass at least partially through said bores whereby maintaining said tooth and adapter in operable combination with each other, and wherein the bore defined by said tooth defines an axis extending generally normal to the central axis of said tooth, with said digging tooth further including an upper surface extending forward and downwardly from the rearward end and toward the cutting edge of said digging tooth, and a lower surface extending forward and upwardly from the rearward end and toward the cutting edge of said digging tooth, and with said digging tooth further including a generally horizontal wing extending laterally outward from an area on one side of said tooth, with said wing having upper and lower surfaces, and with the upper surface of said horizontal wing being disposed in other than a planar relationship relative to the upper surface of said digging tooth, and with said wing being disposed rearward of the axis defined by the bore in said tooth and the rear end of said tooth whereby providing said digging tooth with a progressively widening ground penetration zone for facilitating penetration of said bucket edge.

70. The elongated digging tooth according to claim 69 wherein said is integrally formed as part of and with the remainder of said tooth.

71. The elongated digging tooth according to claim 69 wherein the wing on said tooth has at least one vertically angled forward facing surface for enhancing the ability of said wing to fracture the ground in advance of and thereby protect the transversely extending edge of the bucket against wear.

72. The digging tooth according to claim 69 wherein the upper and lower surfaces of the generally horizontal wing extending laterally outward from the area on said one side of said tooth are disposed in other than a planar relationship relative to both the upper and lower surfaces of said digging tooth.

* * * * *